US006634367B2

(12) United States Patent
Abraham et al.

(10) Patent No.: US 6,634,367 B2
(45) Date of Patent: Oct. 21, 2003

(54) SEALING ENCLOSURE FOR FINGER TIPS

(76) Inventors: Kathleen Hunter Abraham, 11767 NW. 48th St., Coral Springs, FL (US) 33076; Fred F. Anthony, 6113 NW. 66th Way, Parkland, FL (US) 33067

( * ) Notice: Subject to any disclaimer, the term of this patent is extended or adjusted under 35 U.S.C. 154(b) by 0 days.

(21) Appl. No.: 10/105,115

(22) Filed: Mar. 25, 2002

(65) Prior Publication Data

US 2003/0178041 A1 Sep. 25, 2003

(51) Int. Cl.[7] ..... A45D 29/18
(52) U.S. Cl. ..... 132/74.5; 132/285
(58) Field of Search ..... 132/73, 73.5, 74.5, 132/285, 319; 2/21

(56) References Cited

U.S. PATENT DOCUMENTS 2,232,396 A * 2/1941 Lee et al. ..... 2/21
2,283,703 A * 5/1942 Stedman ..... 132/285
2,358,440 A * 9/1944 Bowman ..... 2/21
3,348,541 A * 10/1967 Loebeck ..... 2/21
3,369,553 A * 2/1968 Keesee ..... 132/73.5
4,800,904 A * 1/1989 Kinseley et al. ..... 132/73.5
4,966,174 A * 10/1990 Stanczak ..... 132/73
5,440,774 A * 8/1995 Cole ..... 2/21
5,483,697 A * 1/1996 Fuchs ..... 2/21
5,713,378 A * 2/1998 Smith ..... 132/74.5
5,795,314 A * 8/1998 Berenstein ..... 132/74.5
6,305,383 B1 * 10/2001 Thoma ..... 132/74.5

* cited by examiner

*Primary Examiner*—Todd E. Manahan
(74) *Attorney, Agent, or Firm*—Oltman, Flynn & Kubler

(57) ABSTRACT

A finger tip enclosure apparatus for fitting over and sealingly enclosing a user finger tip and its fingernail includes an enclosure shell having a tubular shell side wall with a side wall proximal end and a side wall distal end, the side wall proximal end including a sealing structure protruding radially inward for making circumferential sealing contact with side surfaces of a human finger, the side wall distal end being sealingly joined to and closed by a distal end wall. The apparatus may retain a fingernail polish solvent in prolonged contact with the fingernail so that polish on the fingernail is dissolved or softened for removal while freeing the to move about and perform manual tasks, and alternatively may retain medication in prolonged contact with the finger tip and fingernail, and still alternatively may shield the finger tip and fingernail from contamination and abrasion.

17 Claims, 25 Drawing Sheets

SEALING ENCLOSURE FOR FINGER TIPS

BACKGROUND OF THE INVENTION

1. Field of the Invention

The present invention relates generally to the field of cosmetic and medical fingernail care. More specifically the present invention relates to a finger tip enclosure apparatus configured and sized to fit over and sealingly enclose a finger tip and its fingernail, for retaining a fingernail polish solvent in prolonged contact with the fingernail so that polish on the fingernail is dissolved or softened for removal while freeing the to move about and perform manual tasks, and alternatively for retaining medication in prolonged contact with the finger tip and fingernail, and still alternatively for shielding the finger tip and fingernail from contamination and abrasion. The apparatus includes an enclosure shell having a tubular shell side wall with a side wall proximal end and a side wall distal end, the side wall proximal end including a sealing structure protruding radially inward for making circumferential sealing contact with side surfaces of a human finger, the side wall distal end being sealingly joined to and closed by a distal end wall.

The sealing structure may include a solid rib or a circumferential inward undulation in the side wall proximal end. The shell optionally includes a bulge protruding radially as part of the side wall and protruding distally as part of the distal end wall to extend the bulge longitudinally to receive a long fingernail. The side wall has a side wall inward surface which optionally includes abrasion elements for dislodging softened polish. The shell may be pre-filled with solvent with a sealing membrane extending across the interior of the shell.

For another embodiment, a longitudinally elongate pad slot is provided in the side wall, and a solvent absorbing pad is secured across and closes the pad slot. Solvent is deposited onto the outward surface of the absorbent pad, whereupon the solvent is absorbed and transmitted through the pad in a wicking action to reach and moisten the fingernail.

2. Description of the Prior Art

There have long been solvents for softening and removing polish from fingernails. The solvent typically is placed in a bowl and user fingers are draped over the rim of the bowl so that the finger tips are immersed in the solvent for perhaps an hour or more. A problem with this arrangement has been that the user is forced to sit in close proximity to the bowl and is unable to perform any manual tasks with the hand or hands which are being treated. Another problem has been that the user often tires of this procedure before the necessary time has elapsed, and lifts her fingers out of the solvent, ultimately prolonging the effort.

It is thus an object of the present invention to provide a sealing enclosure apparatus for finger tips which encloses the finger tips individually while immersing the finger tips in a solution such as fingernail polish solvent or a medication within the enclosure, and which are retained on the finger tips by friction, so that the user is free to move about and his or her fingers are individually free to perform manual tasks such as using the telephone or reading a magazine, and alternatively which is suitable for shielding the finger tips and fingernails against contamination and mechanical damage, or to protect food from contact from unclean finger tips, and finally which is suitable for use on toes as well, such as prior to a pedicure.

It is another object of the present invention to provide such an apparatus for finger tips which prevents evaporation of the solution, whether in the form of polish solvent or medication, by containing the solution while making sealing contact with the finger.

It is still another object of the present invention to provide such an apparatus for finger tips which limits exposure of the user and of persons working and doing business in a salon to solvent fumes.

It is yet another object of the present invention to provide such an apparatus which discourages and makes less tempting the removal of finger tips from the solution prior to full duration contact.

It is a further object of the present invention to provide such an apparatus which optionally contains an abrasive element for dislodging fingernail polish softened by the solvent.

It is an additional object of the present invention to provide such an apparatus which optionally is pre-filled with solution during manufacture and which includes a membrane for retaining the solution until the membrane is ruptured by a user finger tip during mounting of the apparatus on the finger.

It is a still additional object of the present invention to provide such an apparatus which optionally includes a solution passing absorbent pad mounted in a pad opening in an apparatus wall so that solution deposited onto the pad outward surface passes through the pad and into contact with a user fingernail inside the apparatus, the absorbent pad optionally being removable from the apparatus and replaceable.

It is finally an object of the present invention to provide such an apparatus which is easy to use, inexpensive to manufacture and aesthetically pleasing.

SUMMARY OF THE INVENTION

The present invention accomplishes the above-stated objectives, as well as others, as may be determined by a fair reading and interpretation of the entire specification.

A finger tip enclosure apparatus is provided for fitting over and sealingly enclosing a user finger tip and its fingernail, the apparatus including an enclosure shell having a tubular shell side wall with a side wall proximal end and a side wall distal end, the side wall proximal end including a sealing structure protruding radially inward for making circumferential sealing contact with side surfaces of a human finger, the side wall distal end being sealingly joined to and closed by a distal end wall.

The sealing structure preferably includes one of a solid rib and a circumferential undulation in the side wall. The side wall preferably includes at least one internal support rib for strengthening the enclosure shell.

The enclosure shell optionally additionally includes a bulge defining a fingernail chamber and protruding radially outward as part of the side wall and protruding distally outward as part of the distal end wall to receive a user fingernail. The apparatus optionally includes an abrasion element for abrading fingernail polish. The enclosure shell encloses an interior space and the interior space optionally is at least partly filled with a solution, and in this instance the apparatus additionally includes a sealing membrane extending across the interior space within the enclosure shell retaining the solvent; so that when a user fits a finger tip into the proximal end, the finger tip bears against and ruptures the sealing membrane and then enters the interior space and is immersed in the solution, while side surfaces of the user finger simultaneously make sealing contact with the sealing structure. The finger tip enclosure apparatus preferably additionally includes a circumferential membrane abutment rib and the sealing membrane abuts the circumferential membrane abutment rib for strengthened membrane mounting; and an adhesive sealingly bonding the membrane to said membrane abutment rib. The solution optionally has a gel consistency for resisting accidental spilling and spraying.

A finger tip enclosure apparatus is further provided for fitting over and sealingly enclosing a user finger tip and its fingernail, the apparatus including an enclosure shell having a tubular shell side wall with a side wall proximal end and a side wall distal end, the side wall proximal end including a sealing structure for making circumferential sealing contact with side surfaces of a human finger, the side wall distal end being sealingly joined to and closed by a distal end wall; a pad slot in the side wall; and a solvent absorbing pad secured across and closing the pad slot; so that a solution deposited onto the absorbent pad is absorbed and transmitted through the absorbent pad and thereby delivered into contact with a user finger within the enclosure shell.

The absorbent pad preferably includes an abrasive element for dislodging polish from a fingernail within the enclosure shell. The absorbent pad may be impregnated with the abrasive material.

The absorbent pad preferably has pad mounting periphery which protrudes beyond the pad slot and overlaps the side wall, and has pad adhesive on the pad mounting periphery securing the absorbent pad to the side wall as the absorbent pad extends over and closes over the pad slot. The pad slot preferably has a rectangular periphery. The absorbent pad preferably includes an absorbent pad outward surface and an absorbent pad inward surface; a solvent permeable backing sheet bonded to the absorbent pad outward surface and extending laterally to define the pad mounting periphery; and a peel away cover sheet secured to the pad inward surface with a light adhesive to be removable from the absorbent pad when the apparatus is to be used.

A finger tip enclosure apparatus is still further provided for fitting over and sealingly enclosing a user finger tip and its fingernail, the apparatus including an enclosure shell having a tubular shell side wall with a side wall proximal end and a side wall distal end, the side wall proximal end including a sealing structure for making circumferential sealing contact with side surfaces of a human finger, the side wall distal end being sealingly joined to and closed by a distal end wall.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
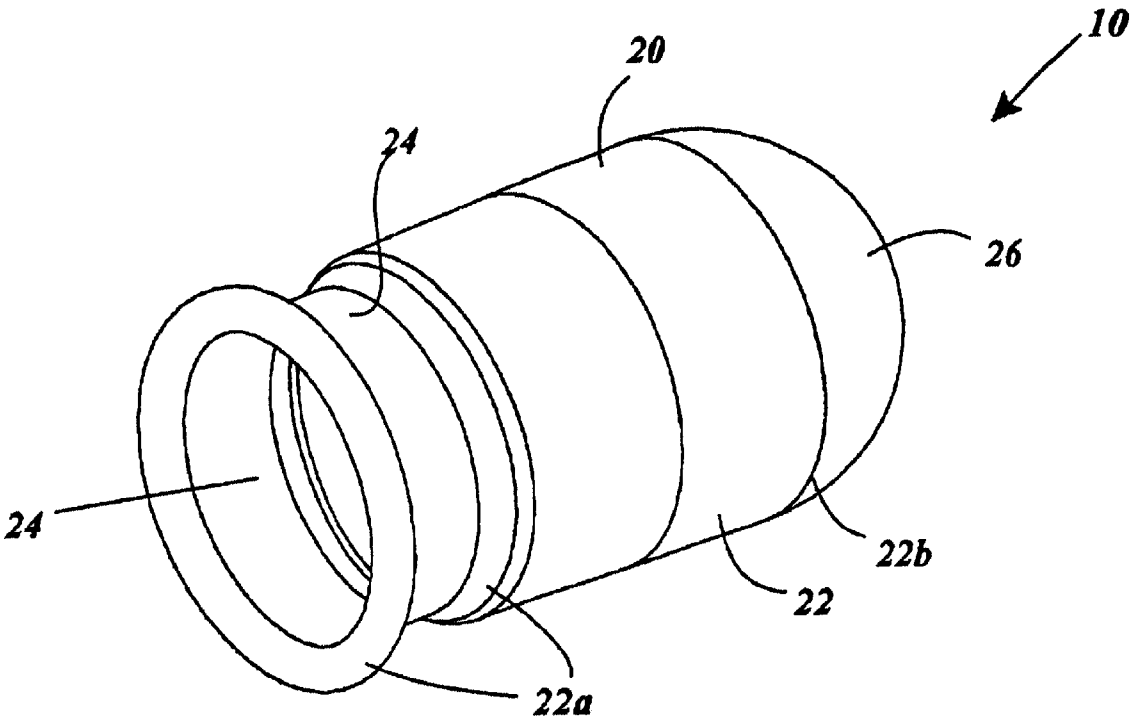
FIG. 1 is a perspective view of the basic enclosure apparatus, having the inward undulation sealing structure.
Figure 2:
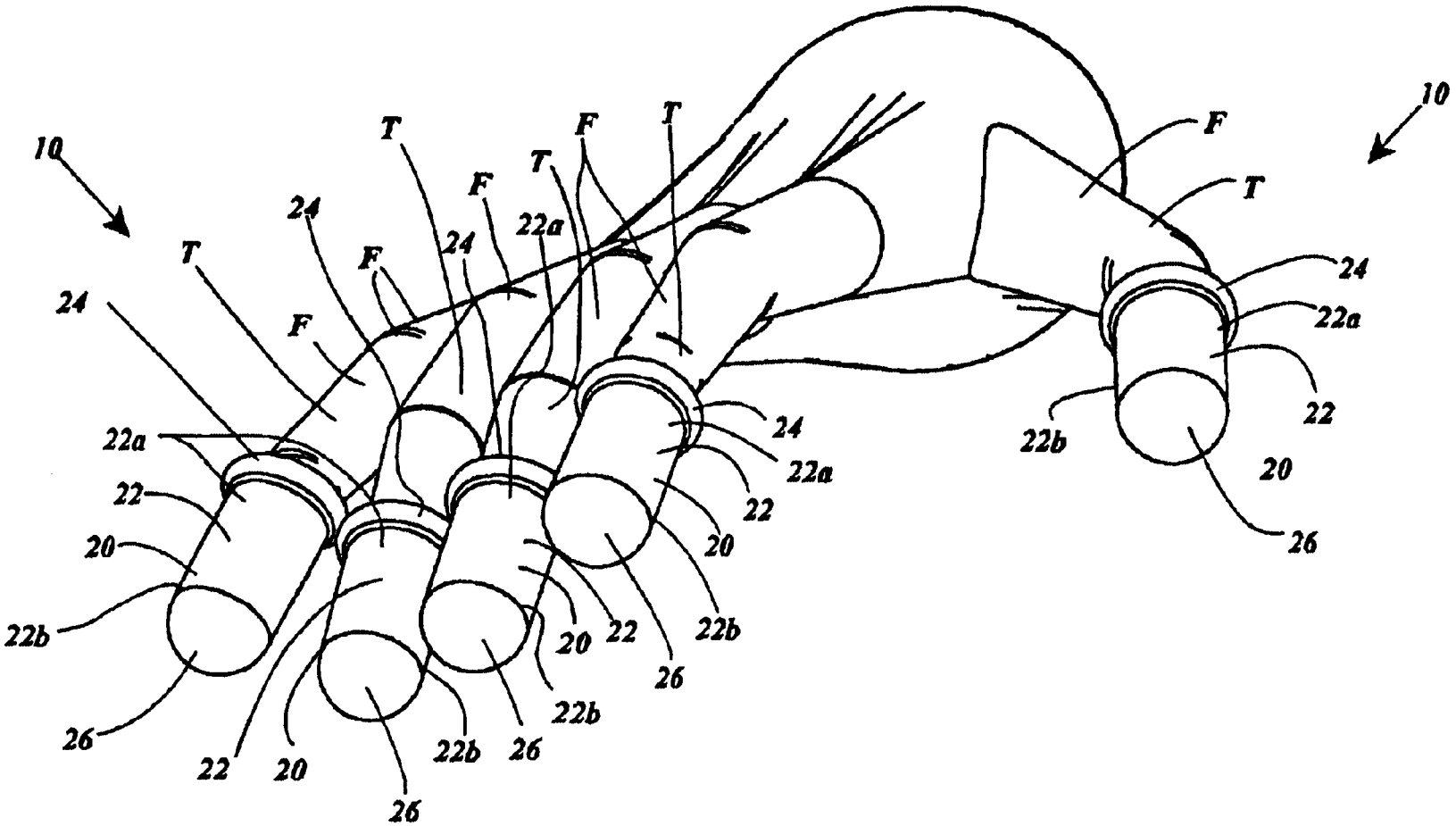
FIG. 2 is a perspective view of five of the apparatus of FIG. 1 fitted onto fingertips of a user right hand.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–25, a finger tip enclosure apparatus 10 is disclosed which is configured and sized to fit over and sealingly enclose a finger tip T and its fingernail N, for retaining a solution S such as a fingernail polish solvent in prolonged contact with the fingernail N so that polish P on the fingernail N is dissolved or softened for removal while freeing the user to move about and perform manual tasks, and alternatively for retaining a solution S in the form of a medication in prolonged contact with the finger tip T and fingernail N, and still alternatively for shielding the finger tip T and fingernail N from contamination and abrasion. Apparatus 10 includes an enclosure shell 20 having a tubular shell side wall 22 with a side wall proximal end 22*a* and a side wall distal end 22*b,* the side wall proximal end 22*a* including a sealing structure 24 protruding radially inward for making circumferential sealing contact with side surfaces of a human finger F, the side wall distal end 22*b* being sealingly joined to and closed by a distal end wall 26.

Figure 3:
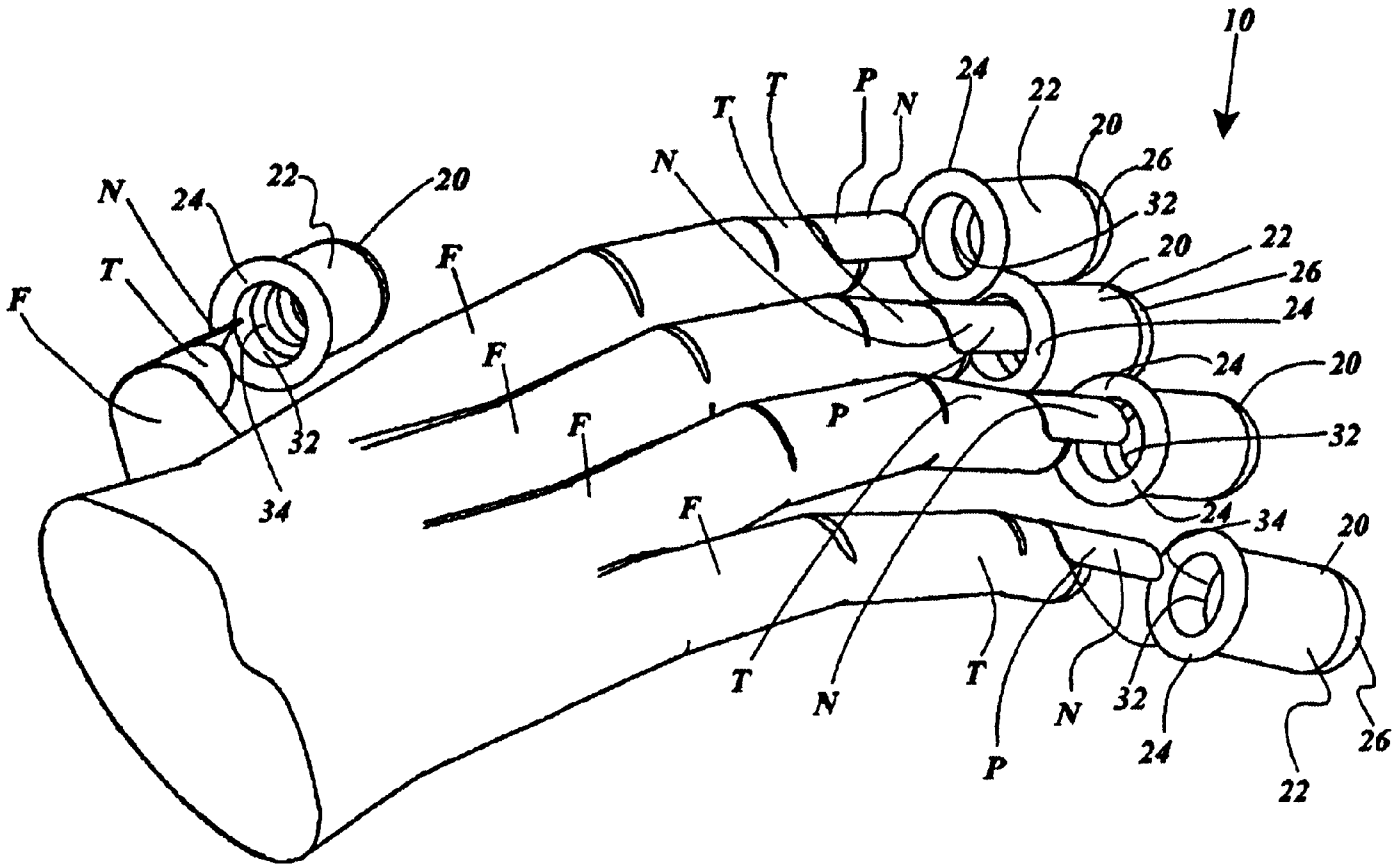
FIG. 3 is a perspective view of the five apparatus and user hand of FIG. 2 with each apparatus positioned forwardly of the finger tip to which it is to be fitted.
Figure 4:
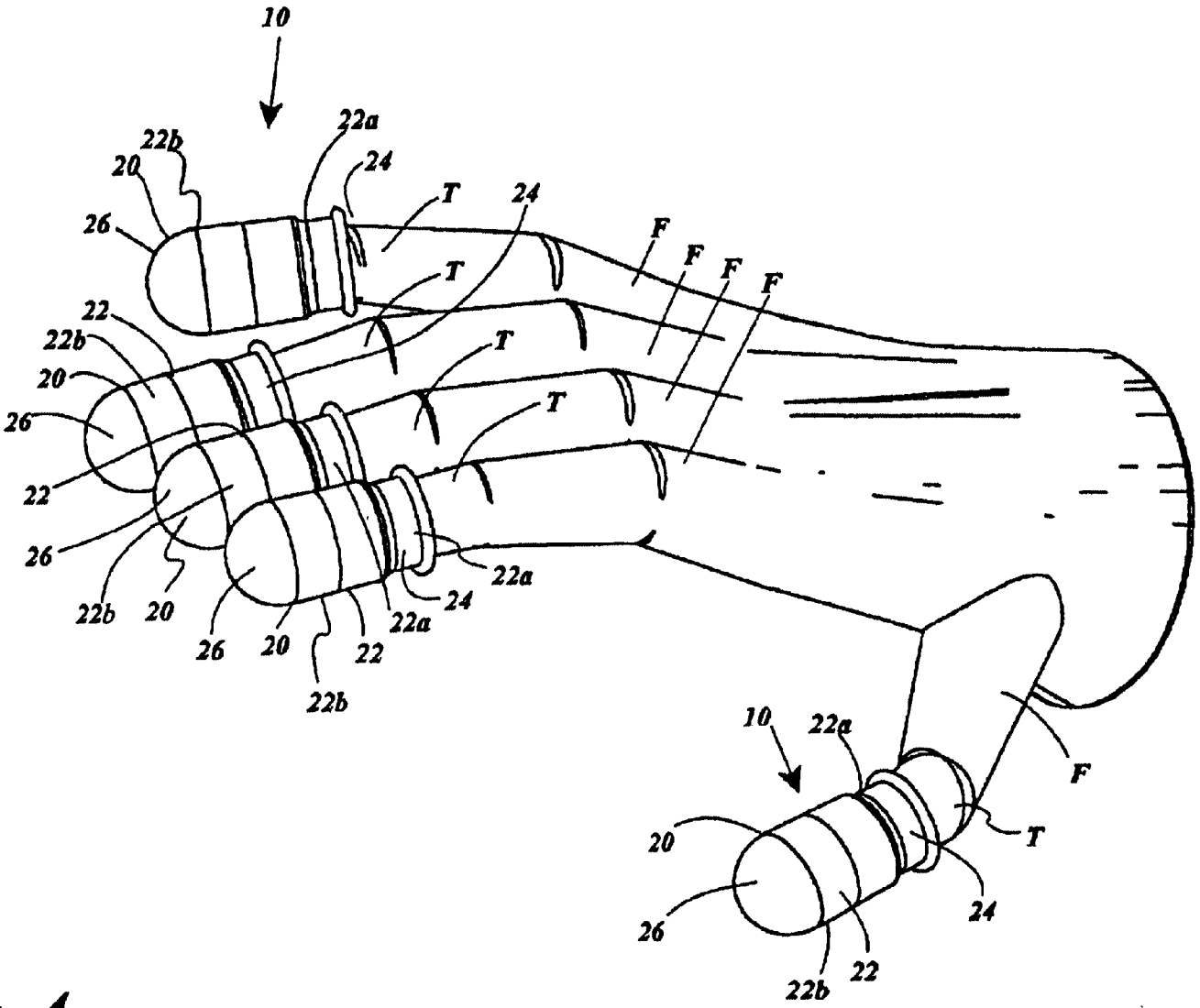
FIG. 4 is another perspective view substantially as in FIG. 2.
Figure 5:
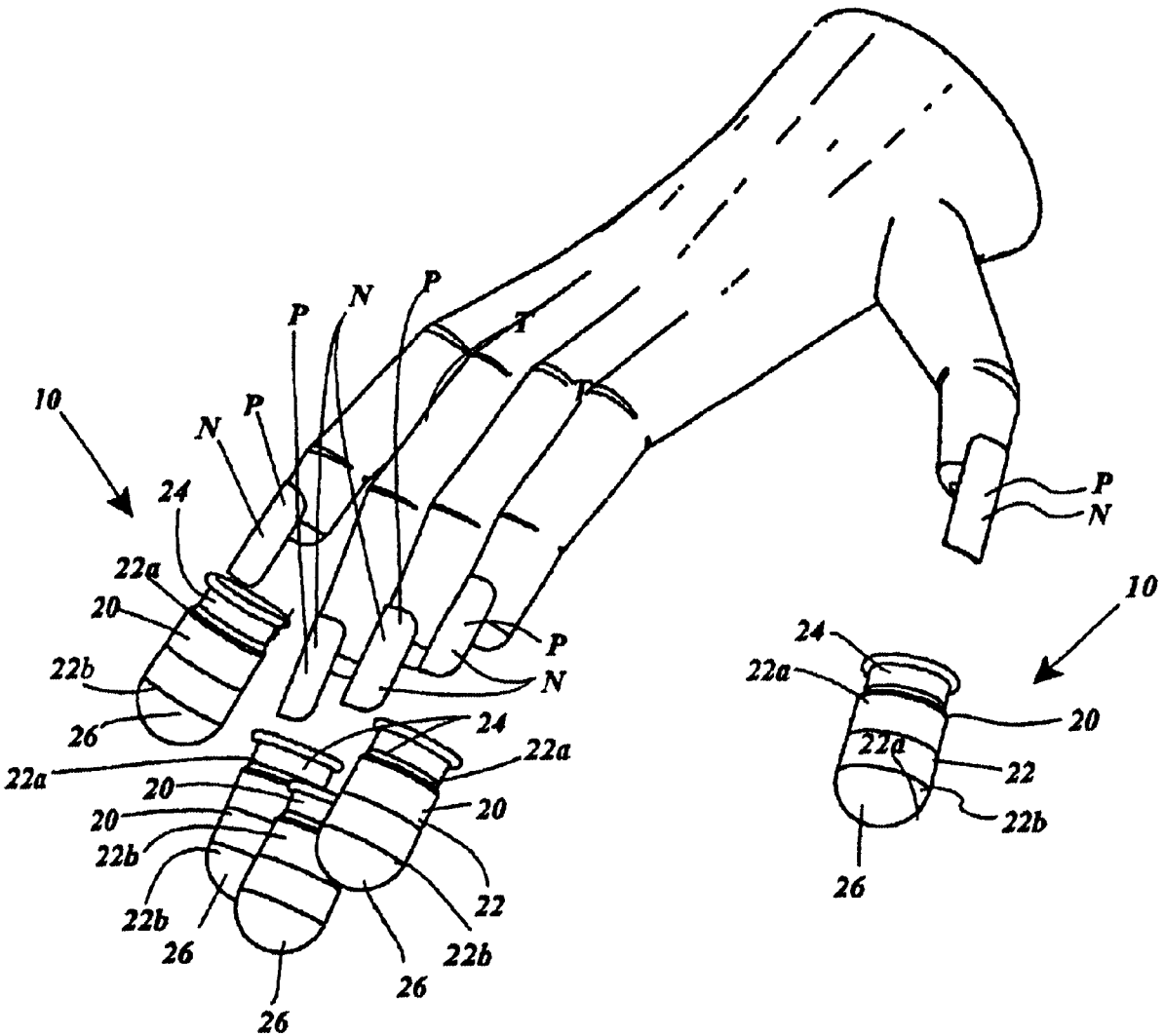
FIG. 5 is another perspective view substantially as in FIG. 3.
Figure 6:
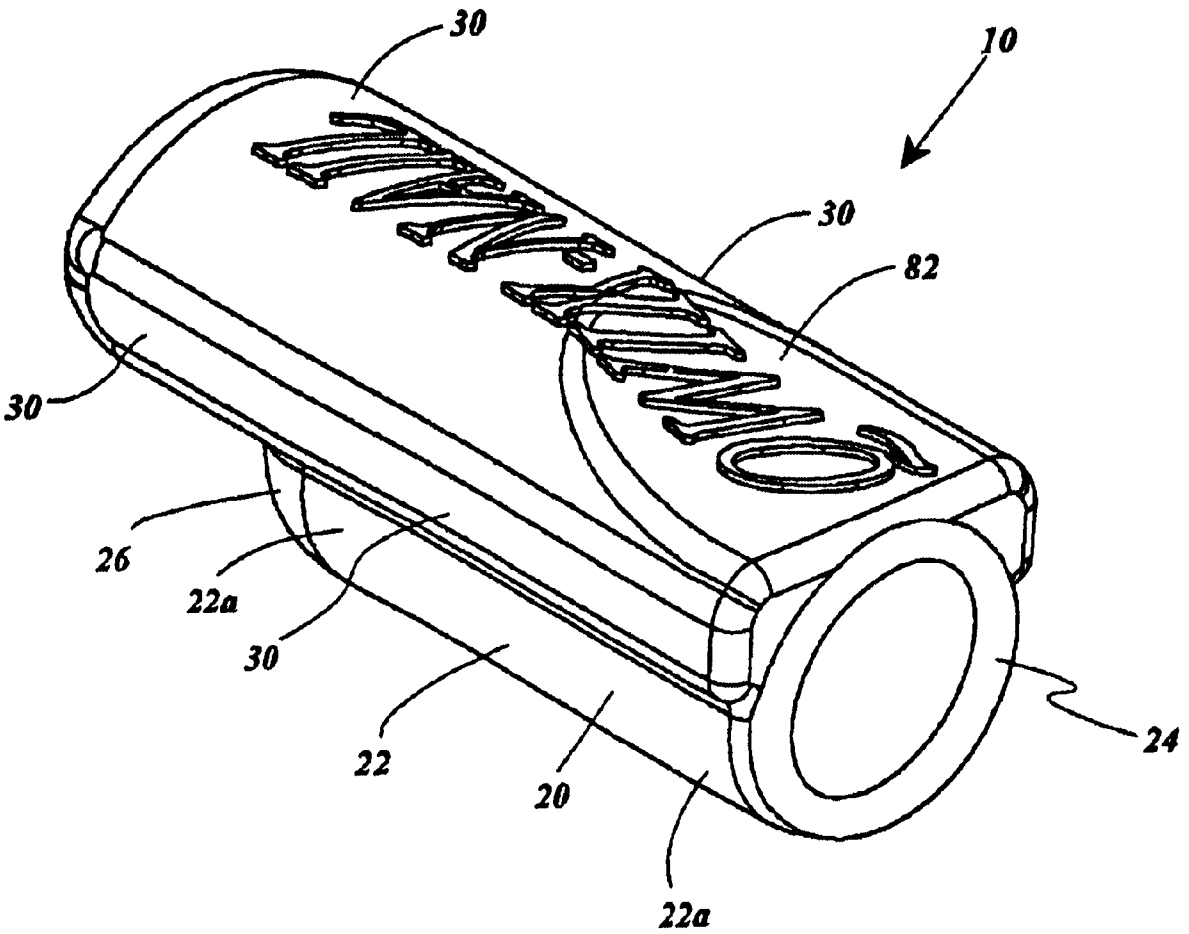
FIG. 6 is a perspective proximal end view of the apparatus having the optional finger chamber feature.
Figure 7:
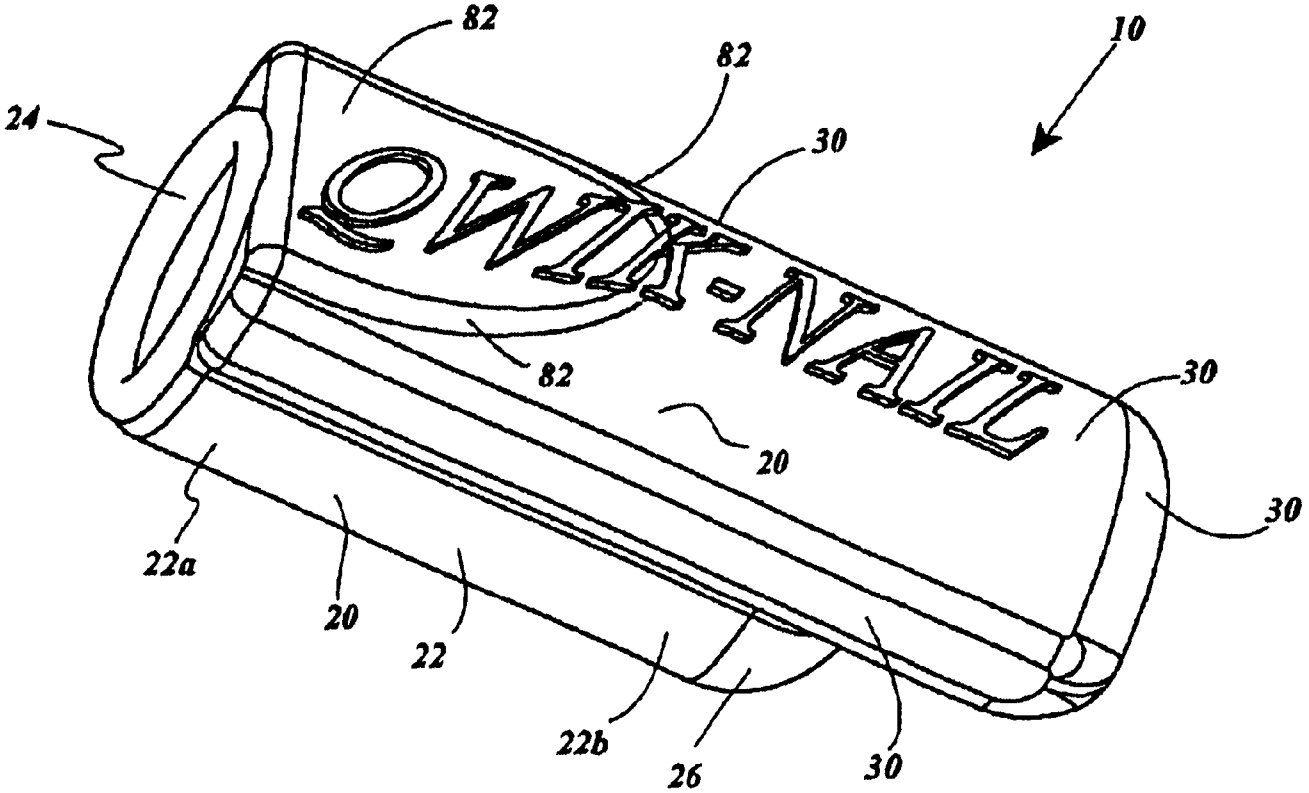
FIG. 7 is a perspective side view of the apparatus as in FIG. 6.
Figure 8:
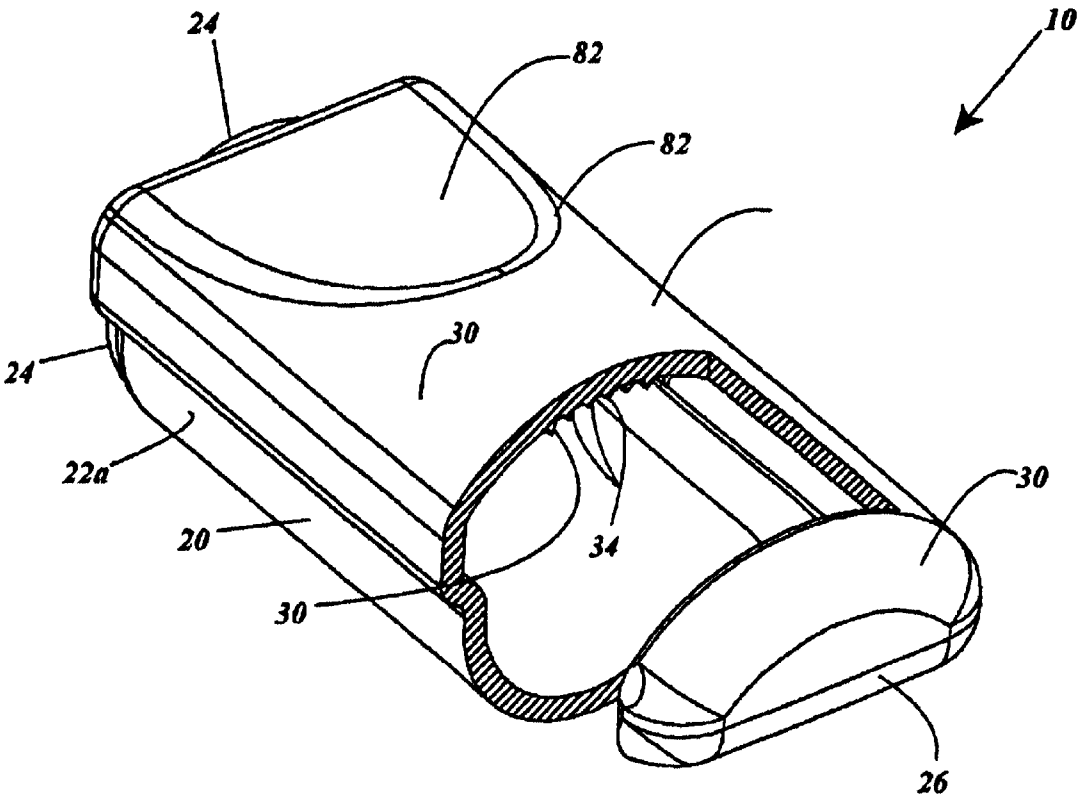
FIG. 8 is perspective distal end view of the apparatus as in FIG. 6, with a section broken away to reveal the interior of the enclosure shell and the optional abrasion elements in the form of longitudinal serrations for dislodging softened fingernail polish.
Figure 9:
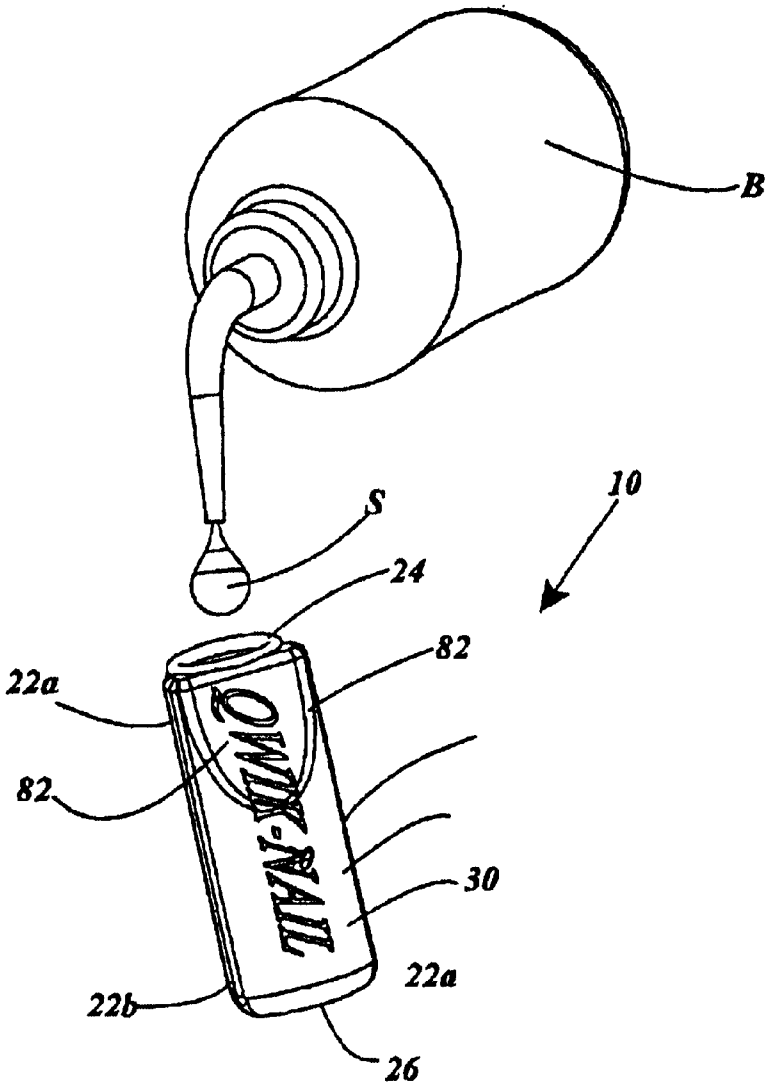
FIG. 9 is a view as in FIG. 7 with the apparatus proximal end oriented upright and solution being delivered into the apparatus from a solution bottle B.
Figure 10:
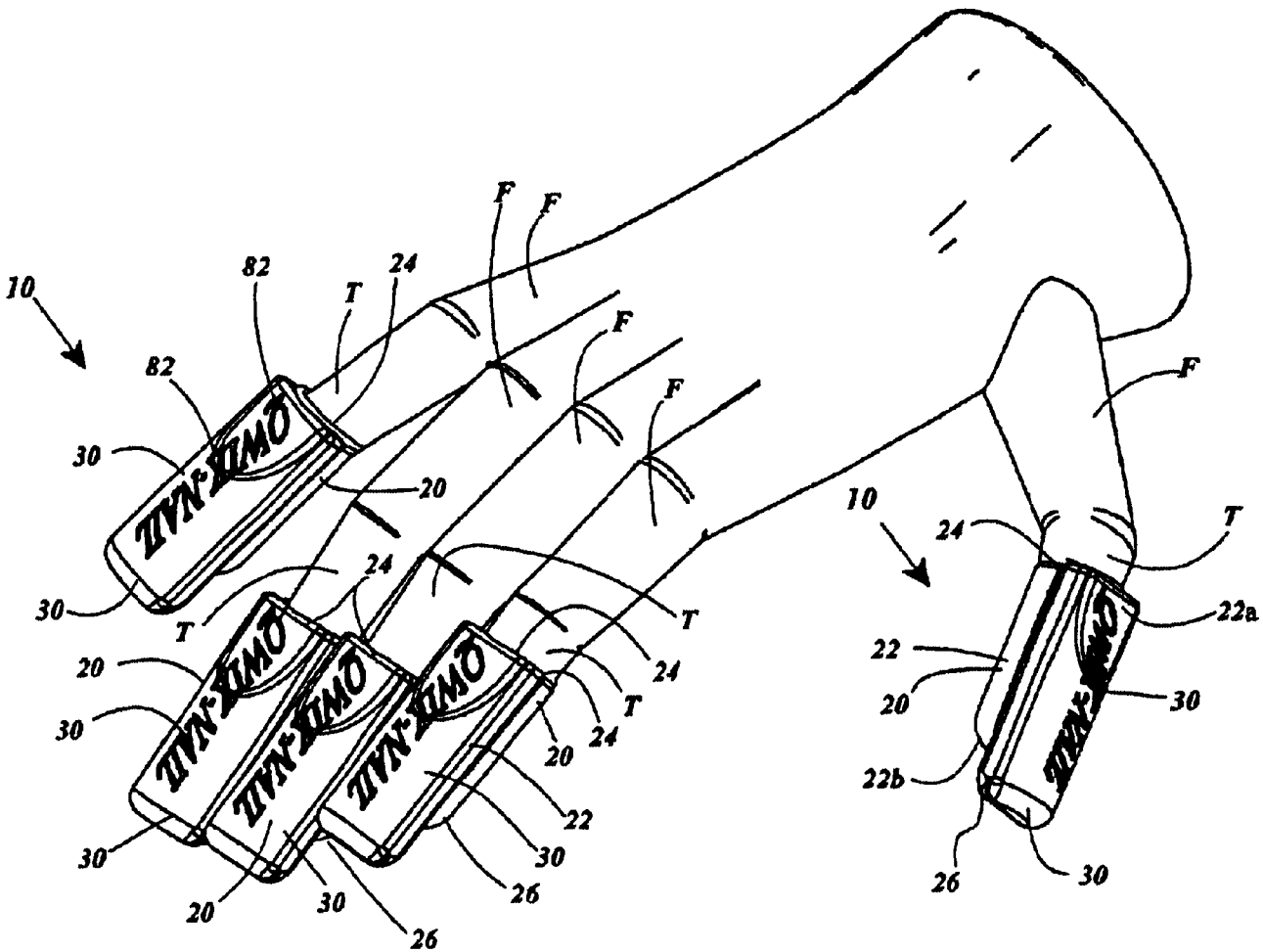
FIG. 10 is a perspective view of five of the apparatus of FIG. 6 fitted onto fingertips of a user right hand.
Figure 11:
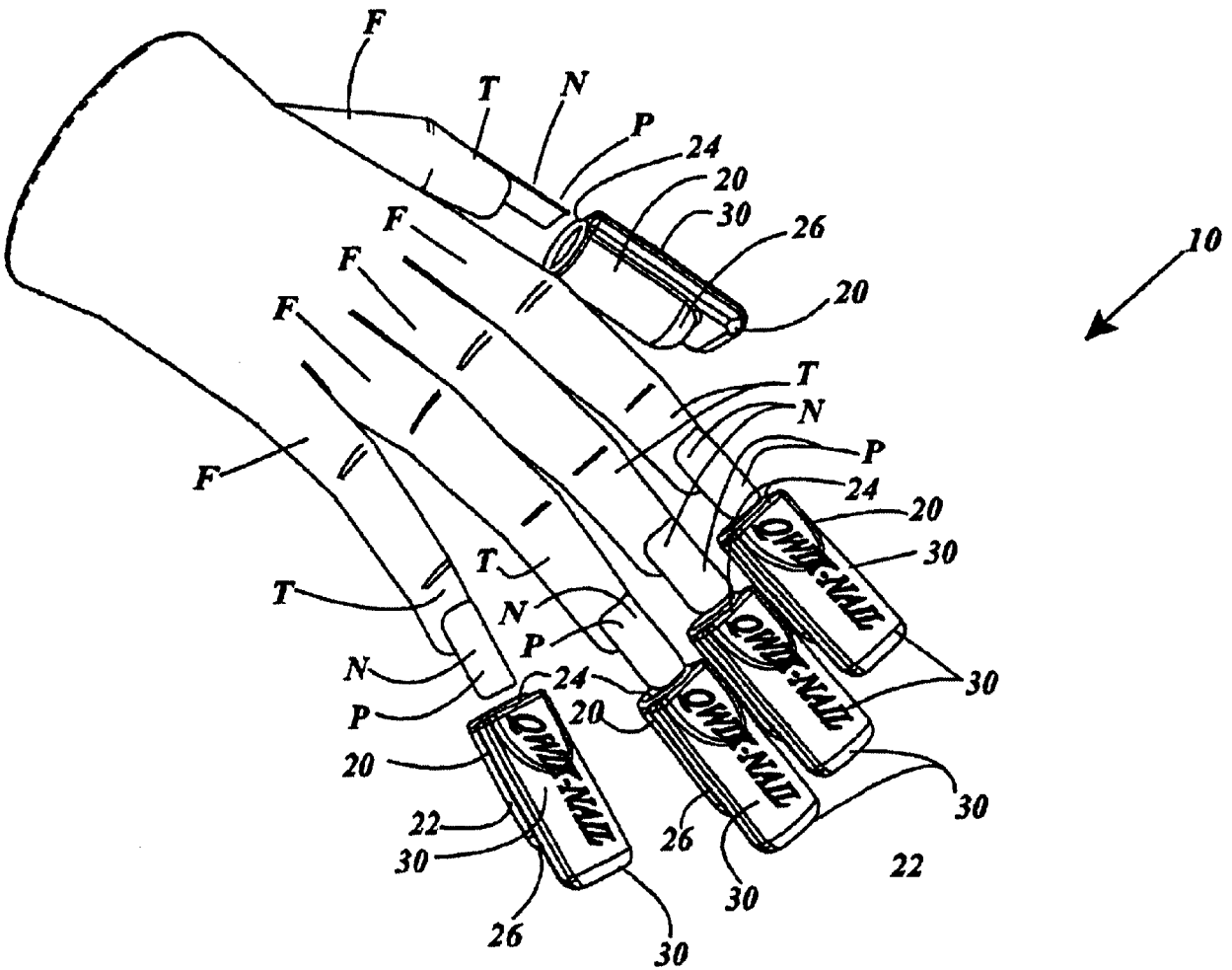
FIG. 11 is a perspective view of the five apparatus and user hand of FIG. 6 with each apparatus positioned forwardly of the finger tip to which it is to be fitted.
Figure 12:
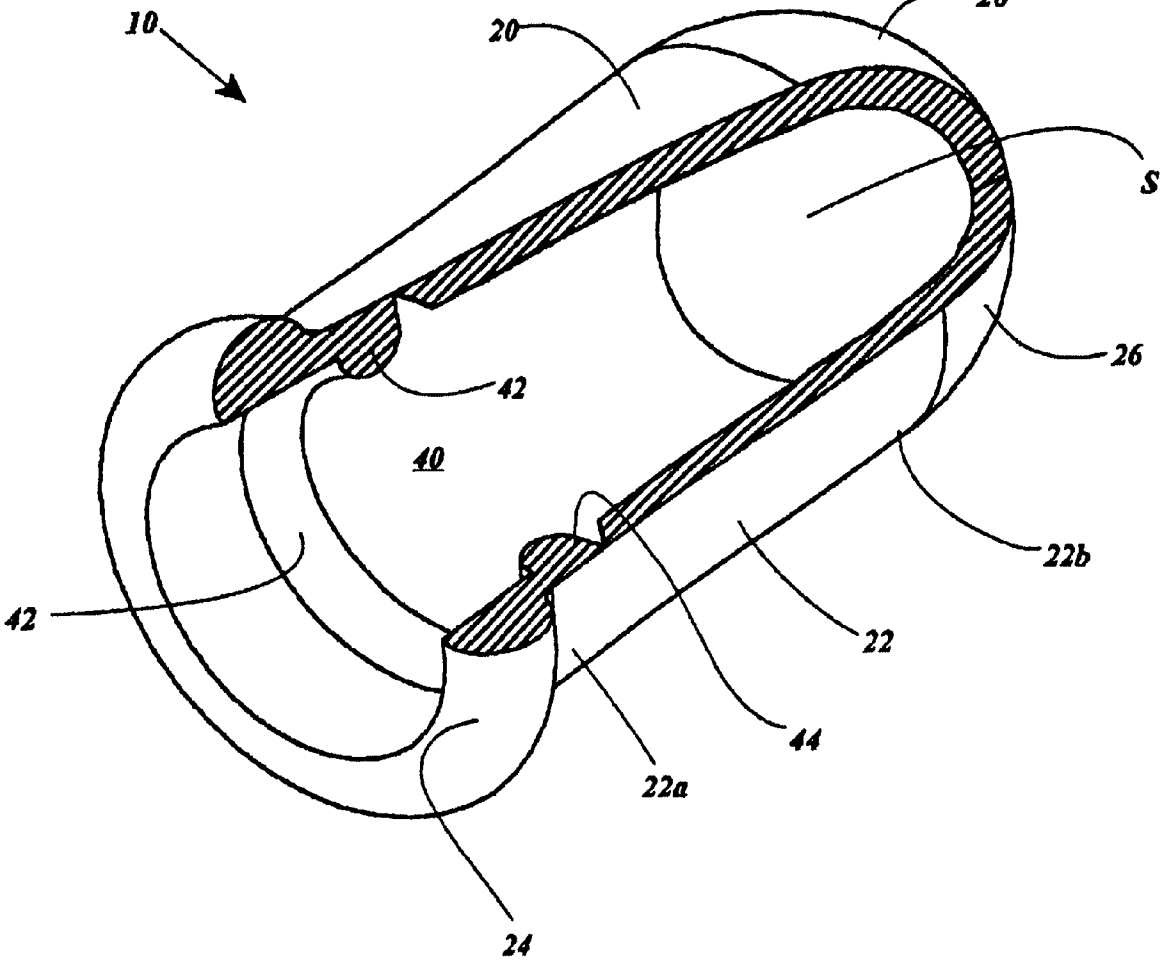
FIG. 12 is a perspective proximal view of the apparatus having the optional pre-filled solvent inserted during apparatus manufacture retained within the apparatus shell by the sealing membrane.
Figure 13:
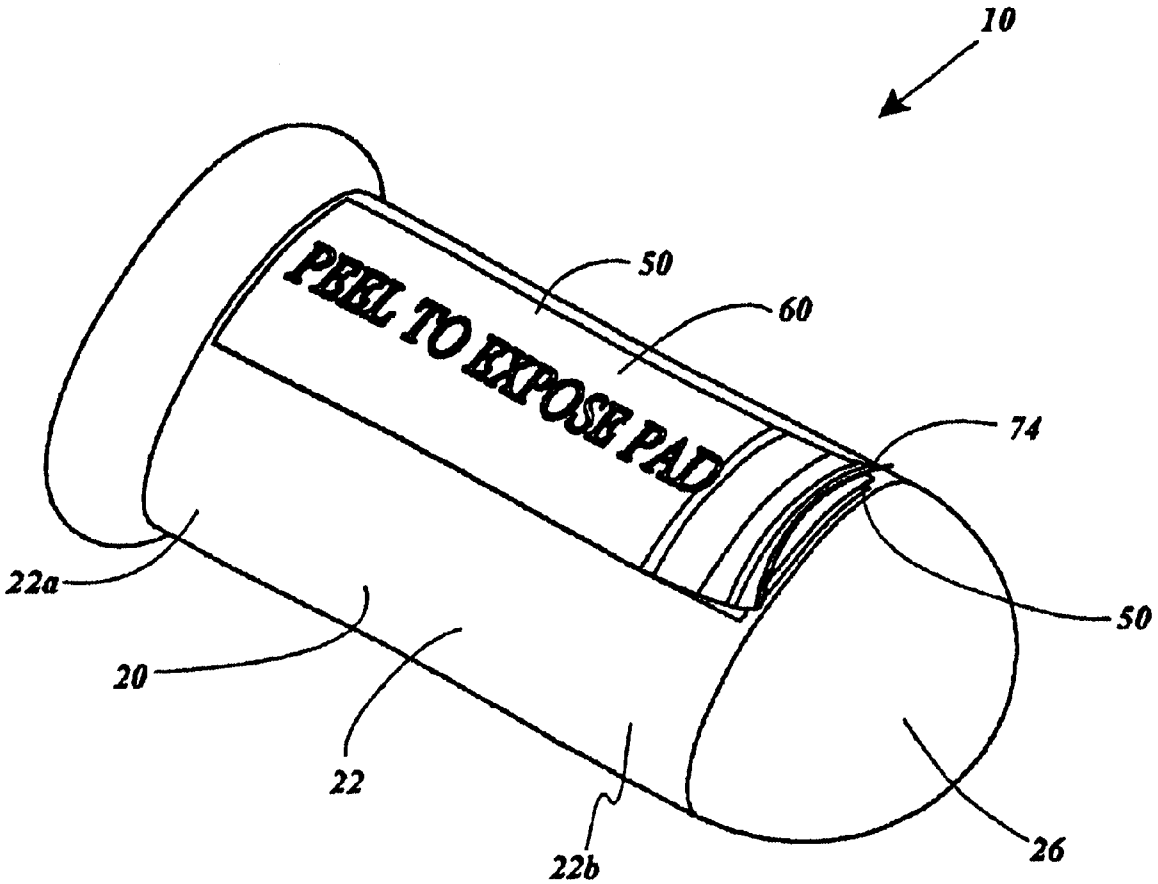
FIG. 13 is a perspective view of a second embodiment of the apparatus having an absorbent pad secured over a pad slot and having a peel away cover sheet over the absorbent pad.
Figure 14:
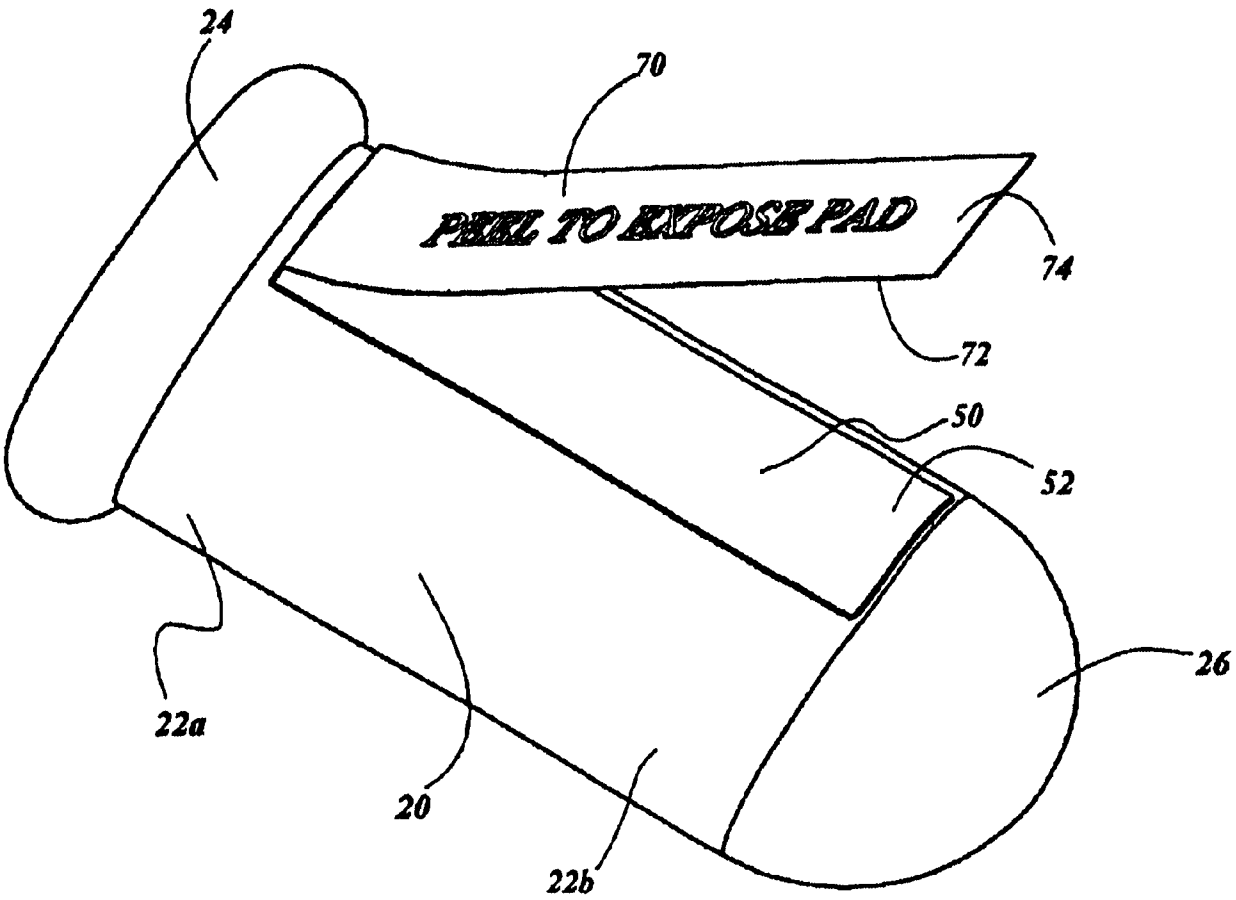
FIG. 14 is a perspective view as in FIG. 13, except that the peel away cover sheet is mostly pulled away from the absorbent pad.
Figure 15:
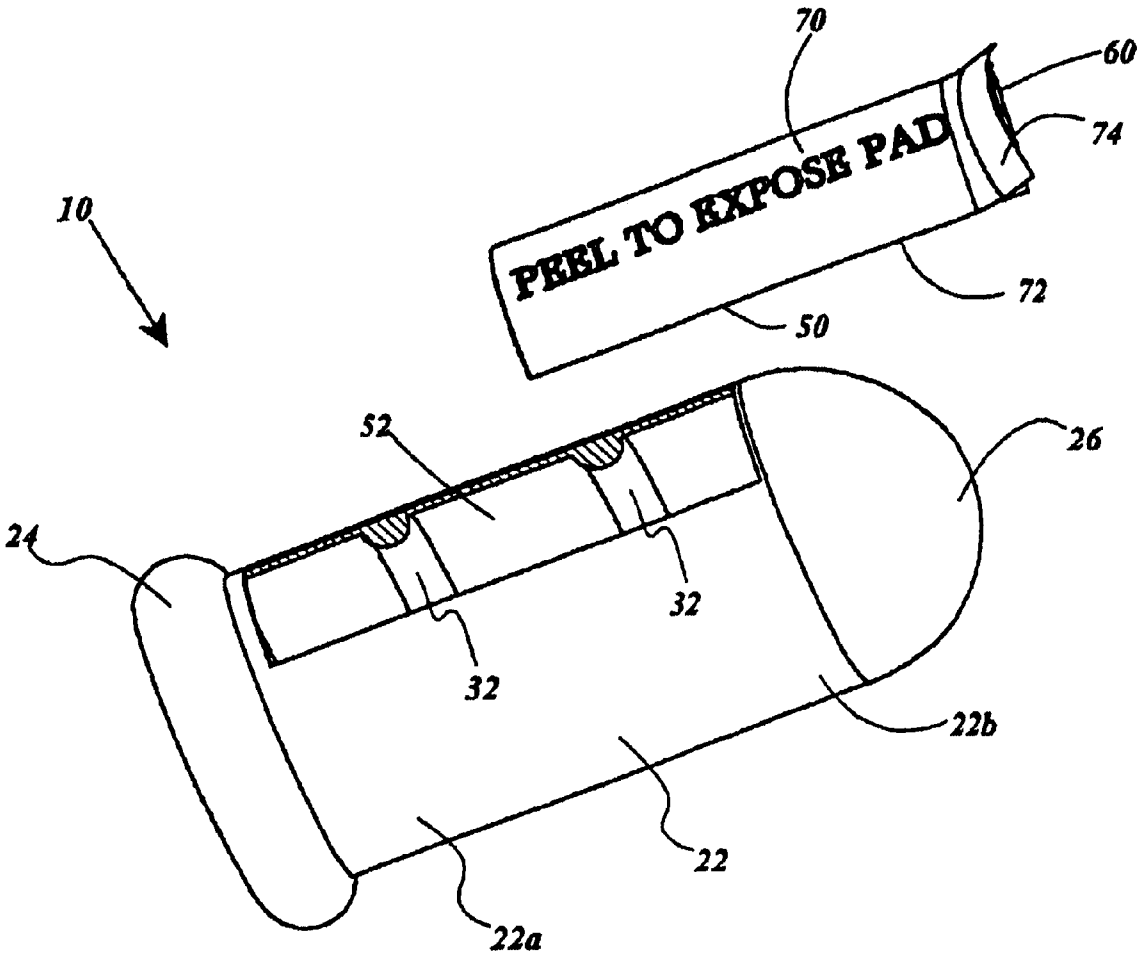
FIG. 15 is a perspective view substantially as in FIG. 13, except that the absorbent pad is shown separated from the apparatus shell, exposing the pad slot and internal shell support ribs.
Figure 16:
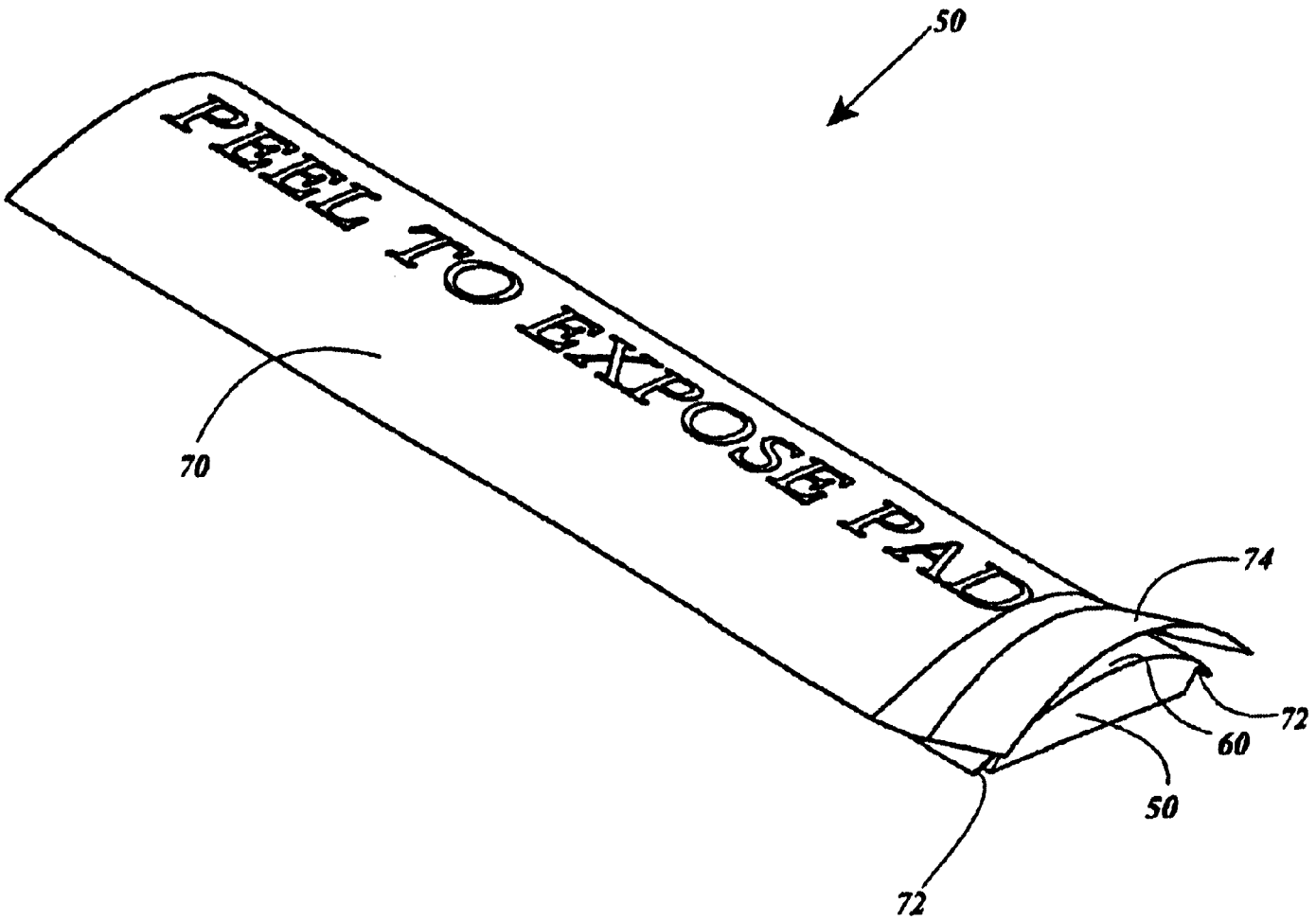
FIG. 16 is a perspective upper view of the preferred absorbent pad.
Figure 17:
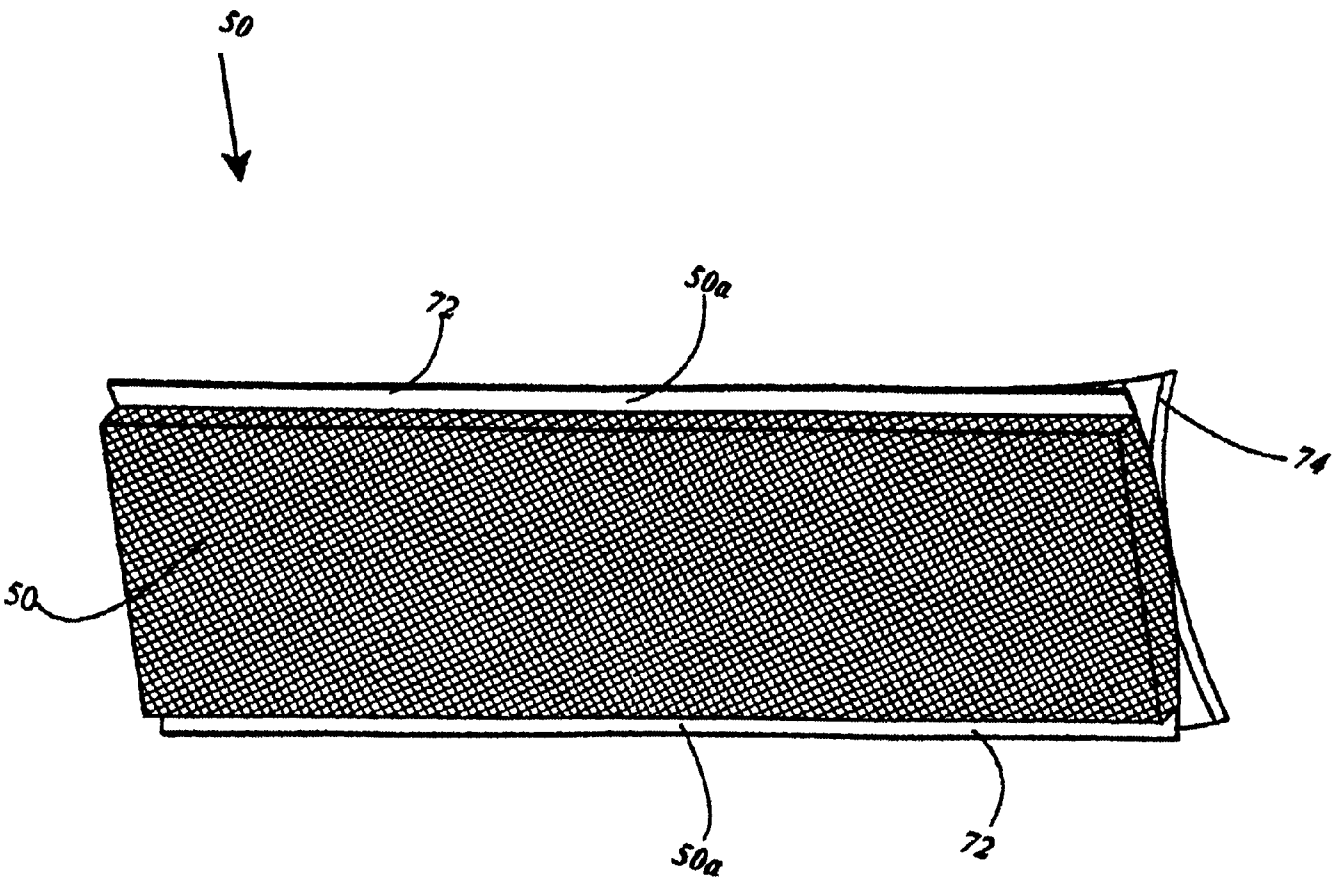
FIG. 17 is a perspective lower view of the preferred absorbent pad.
Figure 18:
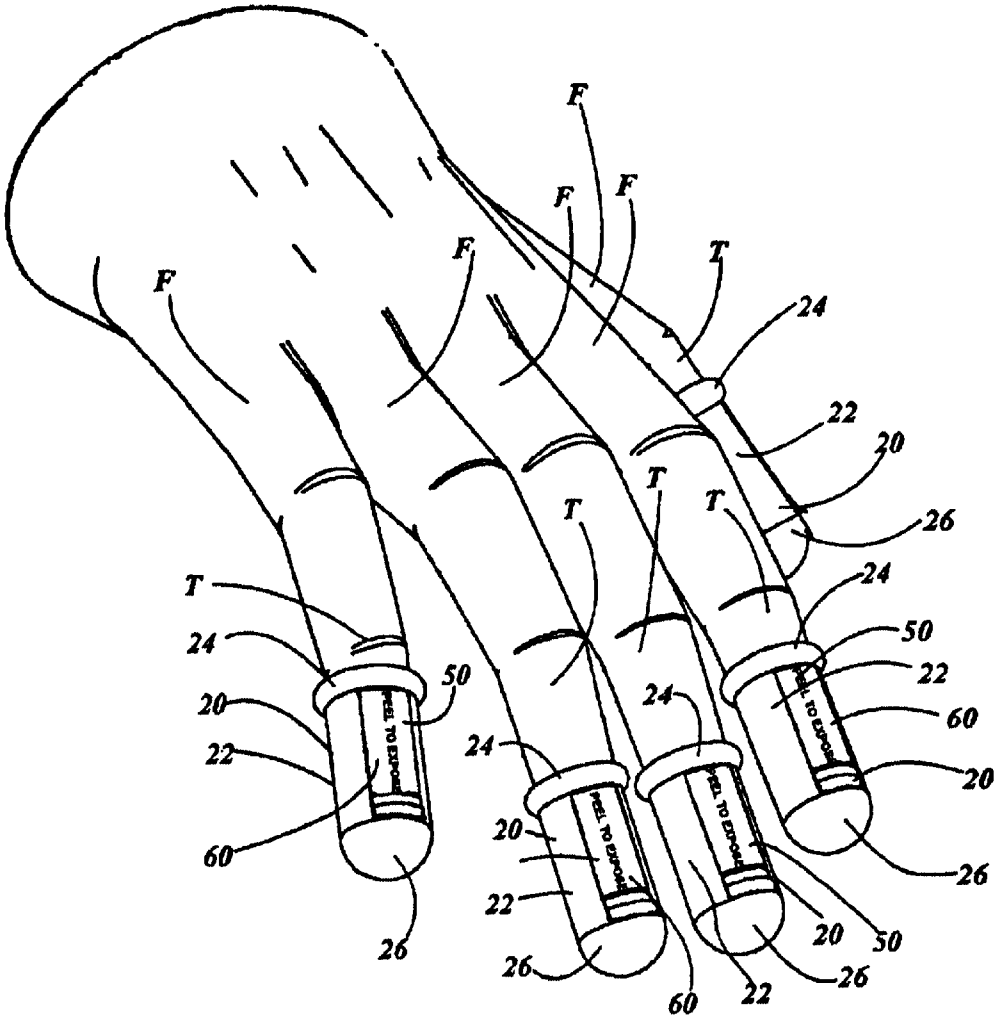
FIG. 18 is a perspective view of five of the apparatus of FIG. 13 fitted onto fingertips of a user right hand.
Figure 19:
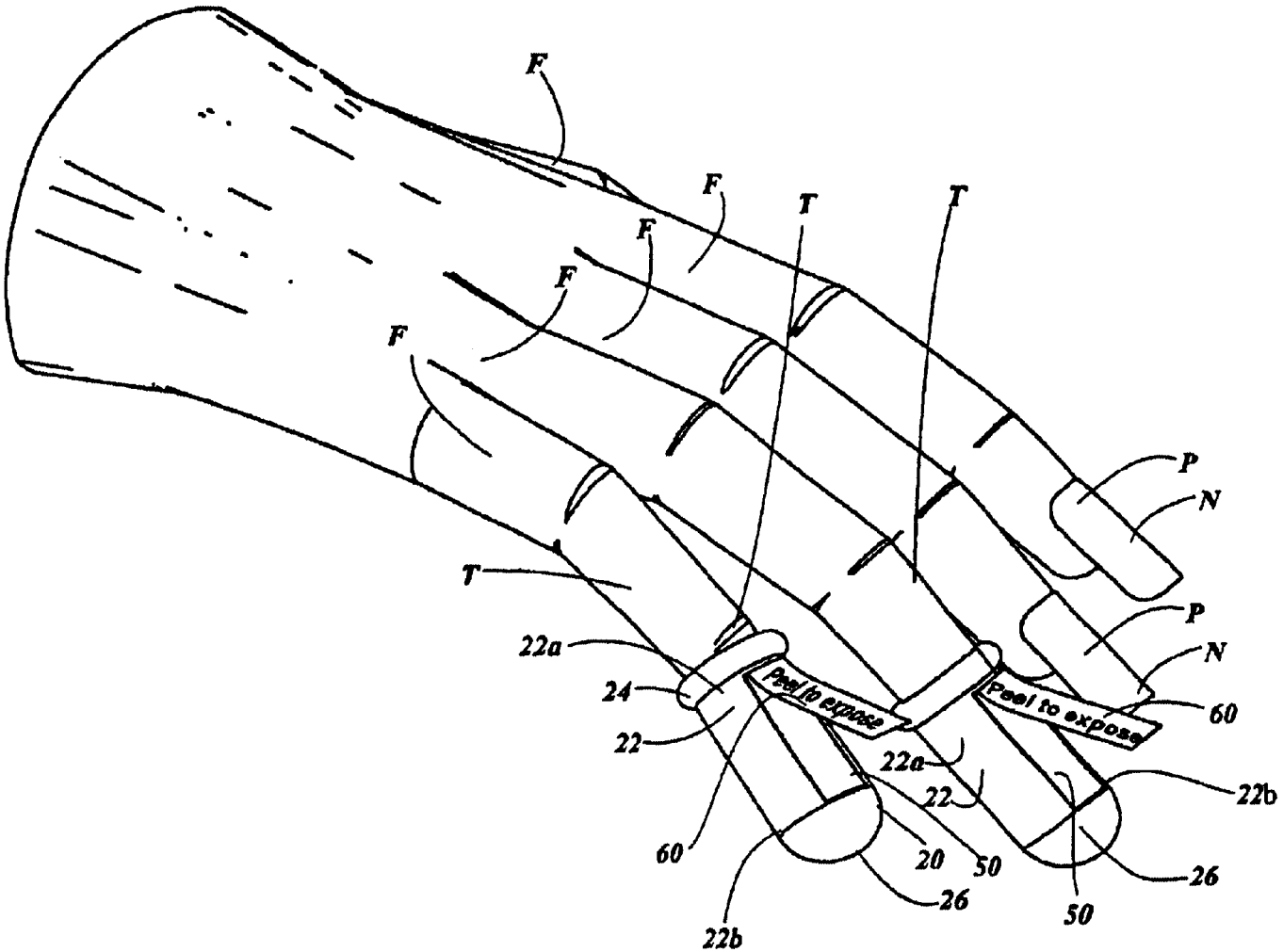
FIG. 19 is a view substantially as in FIG. 18, except that the apparatus on three of the finger tips are removed and the peel away cover sheets on the remaining two finger tips are shown peeled away from the absorbent pad.
Figure 20:
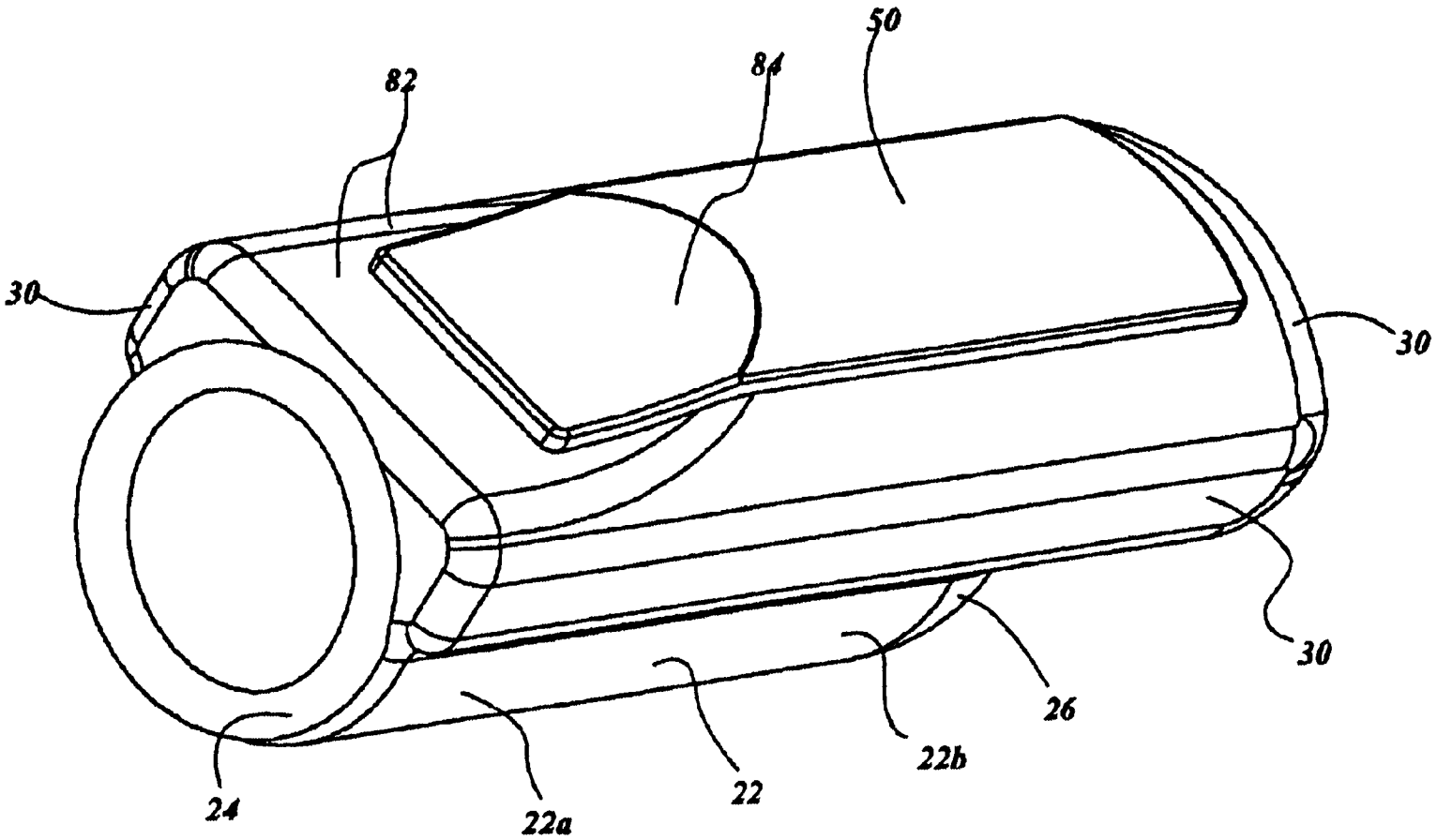
FIG. 20 is a perspective view of the apparatus substantially as in FIG. 13, except for the inclusion of the aesthetically preferred ramped pad and shell feature.
Figure 21:
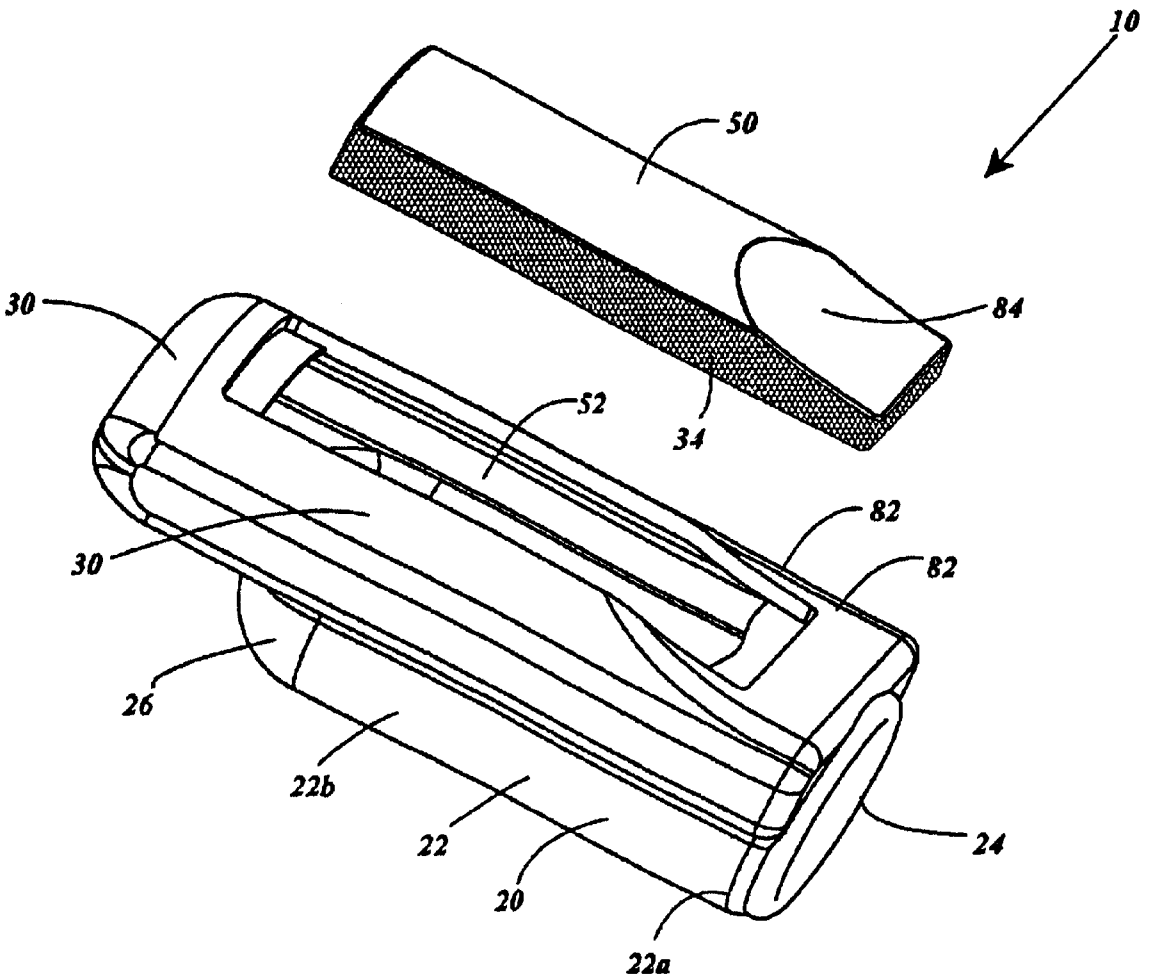
FIG. 21 is a view of the apparatus as in FIG. 20, except that the absorbent pad is shown removed and spaced apart from the pad slot in the apparatus shell.
Figure 22:
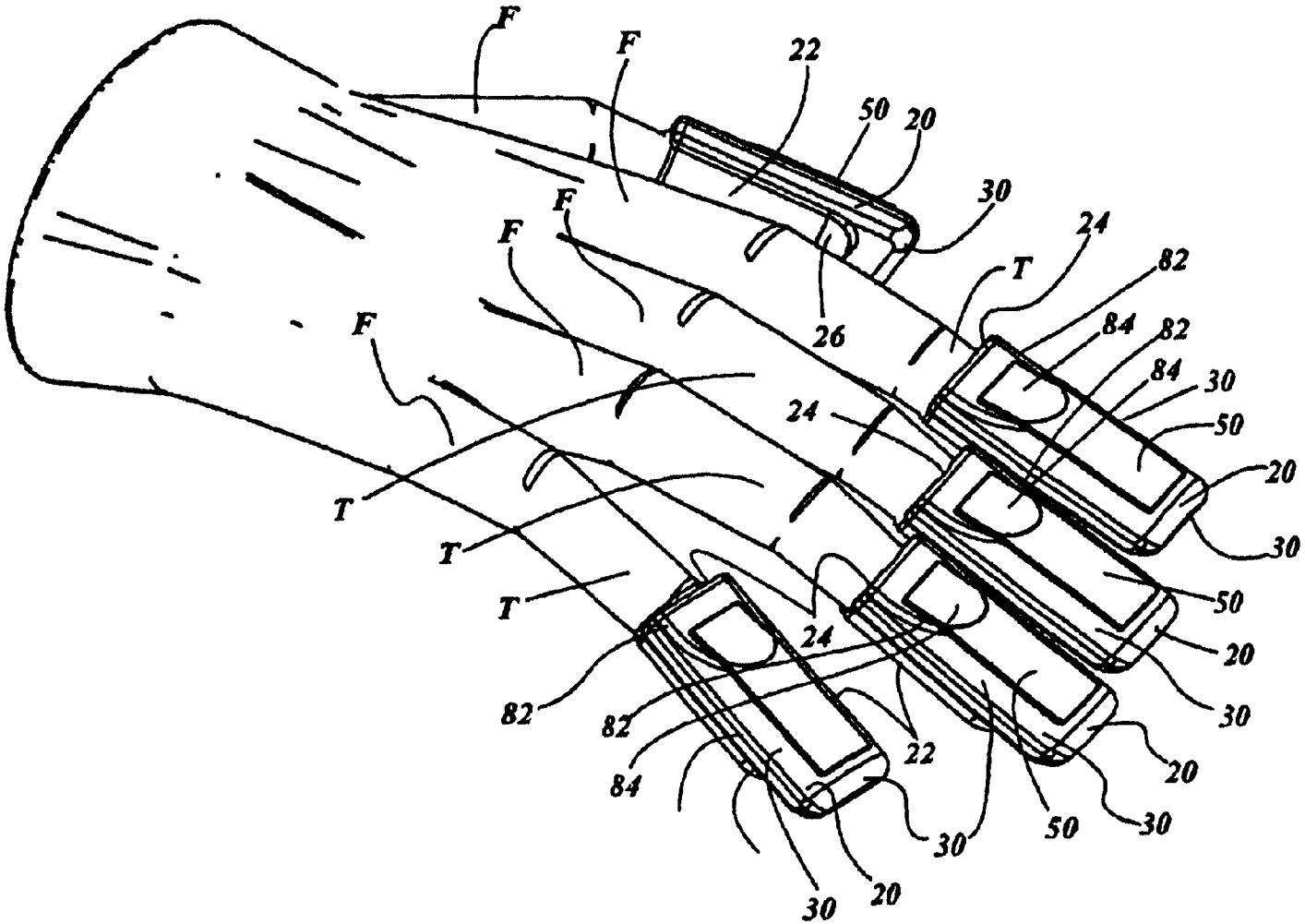
FIG. 22 is a perspective view of five of the apparatus of FIG. 20 fitted onto fingertips of a user right hand.
Figure 23:
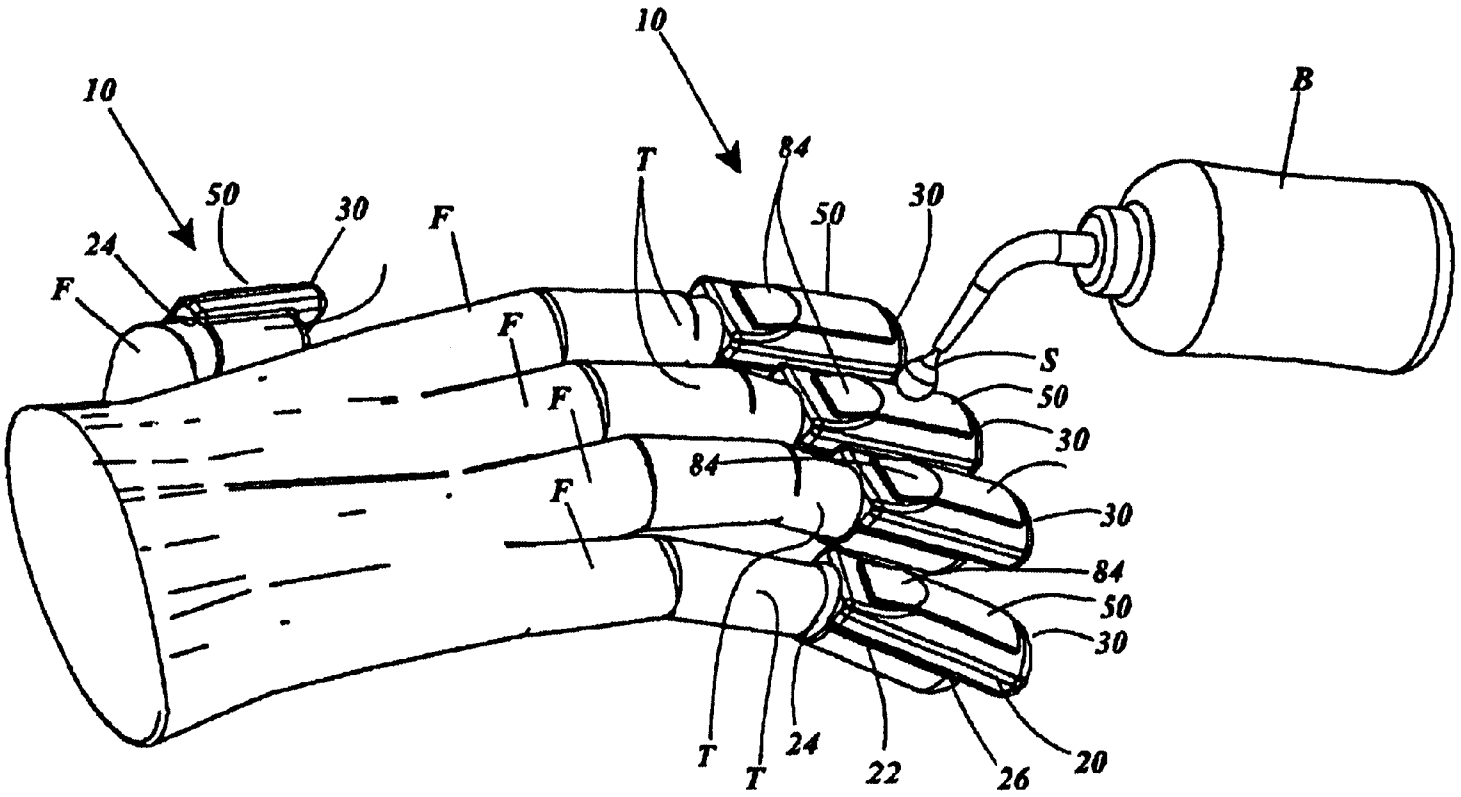
FIG. 23 is a perspective side view substantially as in FIG. 22, additionally showing solution being deposited onto one of the absorbent pads from a solution bottle.
Figure 24:
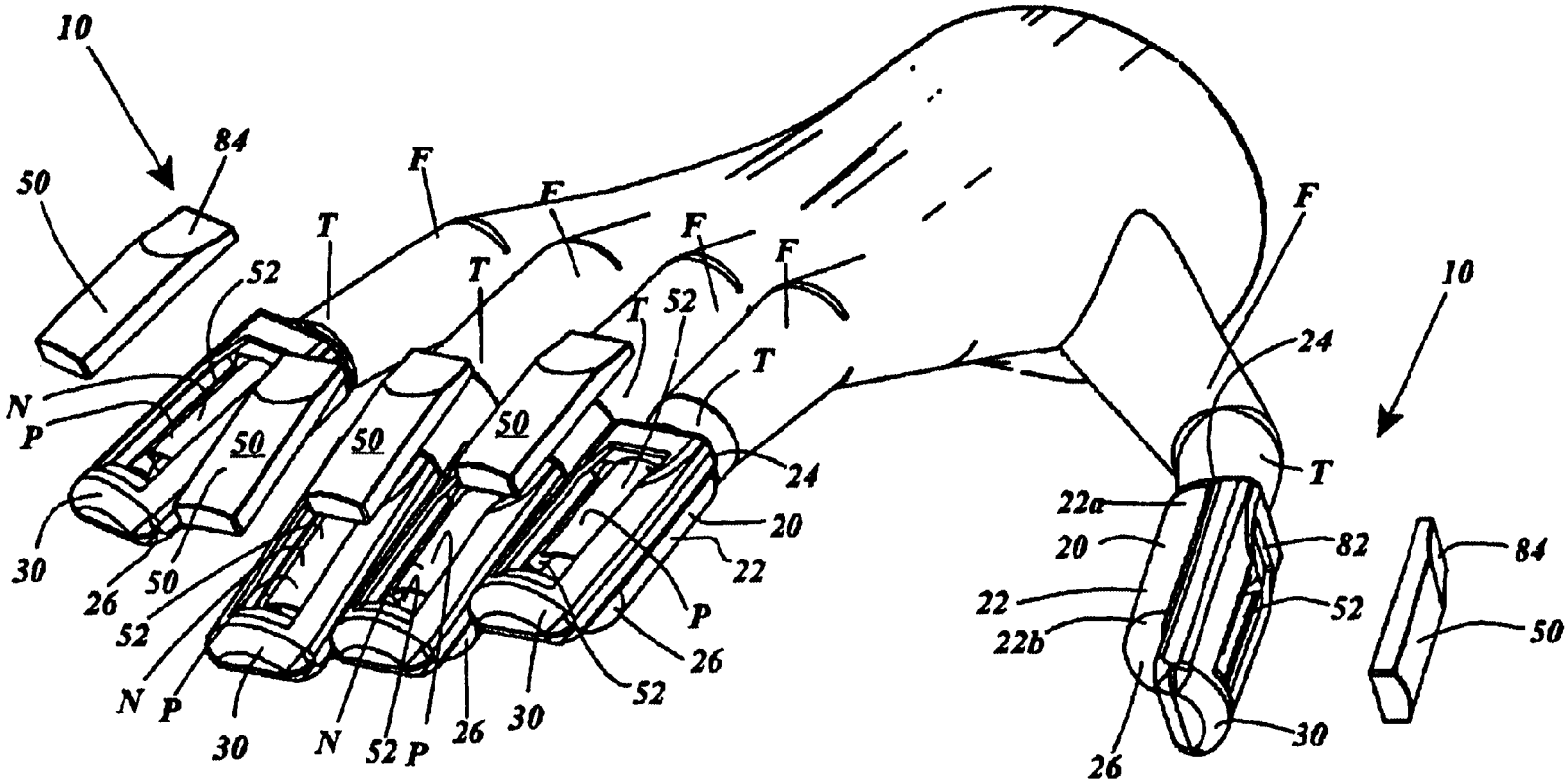
FIG. 24 is a perspective forward view substantially as in FIG. 22, with the absorbent pads shown removed from their pad slots in the apparatus shells.
Figure 25:
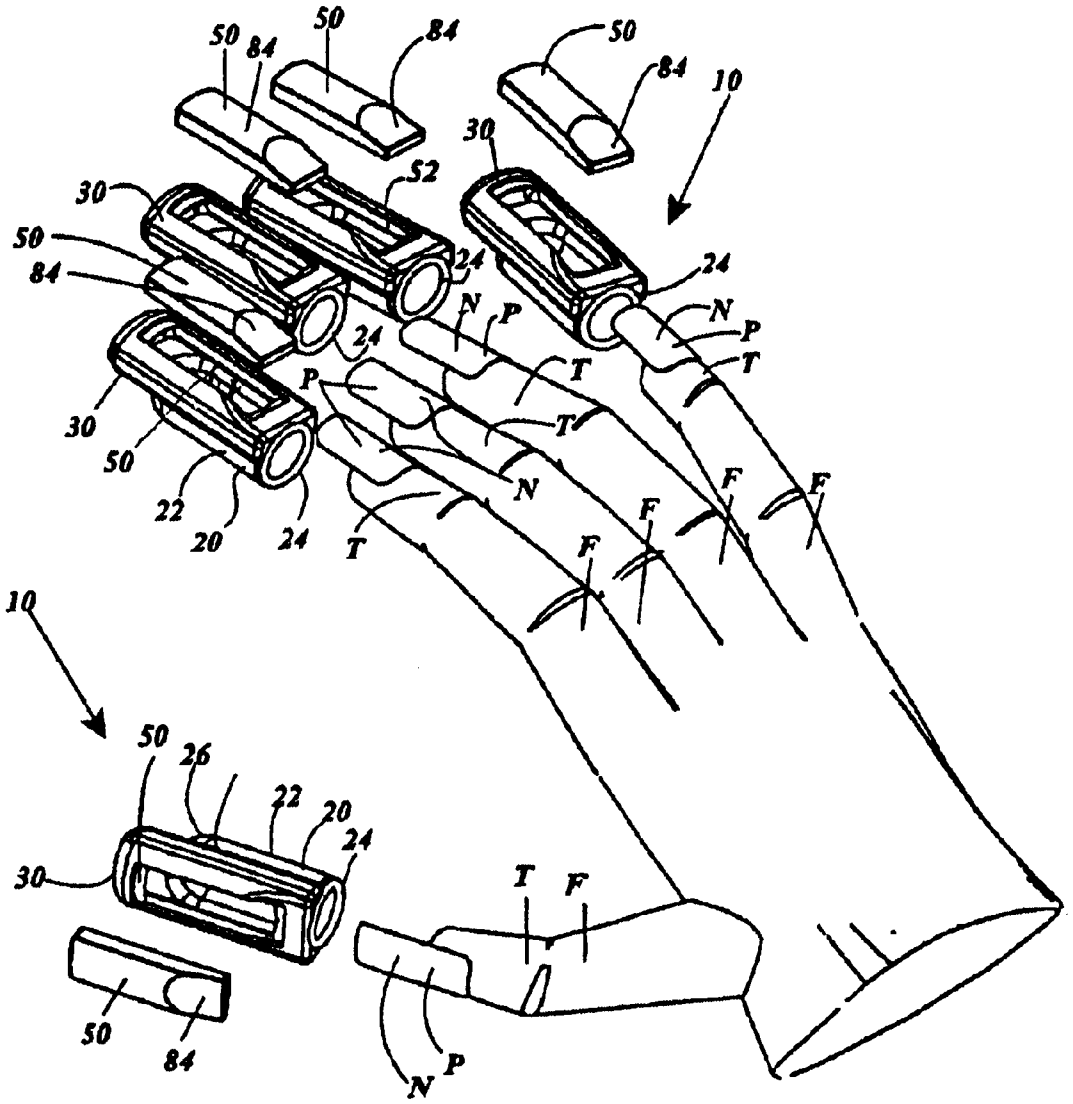
FIG. 25 is a perspective view of the five apparatus and user hand of FIG. 24 with each apparatus positioned forwardly of the finger tip to which it is to be fitted.

The sealing structure 24 may include a solid rib (as shown in FIG. 3) or a circumferential inward undulation (as shown FIG. 1) in the side wall proximal end 22*a*. The side wall 22 optionally includes internal circumferential support ribs 32 which strengthen the shell 20 and which optionally make sealing contact with side surfaces of the user finger F.

Shell 20 optionally includes a bulge protruding radially outward as part of side wall 22 and protruding distally outward as part of distal end wall 26 to extend the bulge longitudinally to receive a long fingernail N. See FIGS. 6–8. Since the bulge is simply part of the side wall 22, it is in open fluid communication with the remainder of the shell 20 interior, and defines a fingernail chamber 30.

Side wall 22 has a side wall inward surface which optionally includes abrasion elements 34 such as serrations, and is positionable directly over a user fingernail N. See FIG. 8. Support ribs 32 also may function as abrasion elements 34. As a result, the user can apply pressure radially inward against side wall 22 and thereby press the abrasion elements 34 into contact with nail polish P softened by solution S, and rub the abrasion elements 34 against and dislodge the nail polish P.

Shell 20 may be pre-filled with a solution S with a sealing membrane 40 extending across the interior of shell 20. See FIG. 12. The sealing membrane 40 preferably abuts a circumferential membrane abutment rib 42 for more secure membrane 40 mounting, and an adhesive 44 sealingly bonds the membrane 40 to membrane abutment rib 42. For this version of apparatus 10, the solvent S preferably is in gel form, such as acetone or a medication gel, to resist accidental spilling and spraying. When this version of apparatus 10 is to be used, the user fits a finger tip T into the side wall proximal end 22*a* such that the finger tip T bears against and ruptures the sealing membrane 40 and then enters the side wall distal end 22*b* of apparatus 10 and is immersed in the solution S, while the side surfaces of the finger F simultaneously make sealing contact with sealing structure 30. The membrane abutment rib 42 may additionally function as the sealing structure 30 or as a support rib 32.

For another embodiment, a longitudinally elongate pad slot 52 is provided in side wall 22, and a solvent absorbing pad 50 is secured across and closes the pad slot 52. See FIGS. 13–15. Apparatus 10 is oriented on the user finger F so that the absorbent pad 50 is positioned directly over the fingernail N, and solution S is deposited onto the outward surface of the absorbent pad 50, whereupon the solution S is absorbed and transmitted through the pad 50 in a wicking action to reach and moisten the fingernail N. The absorbent pad 50 itself optionally may be made to function as an abrasive element 34 by impregnating the pad 50 with abrasive material such as hard granules for sliding over and dislodging softened fingernail polish P. The absorbent pad 50 preferably is fitted over the pad slot 52 so that pad 50 edges overlap the pad slot 52 at the pad periphery 50*a,* and pad adhesive 54 which is not soluble by the solvent S preferably removably secures the pad 50 to the side wall 22 along the mounting periphery 50*a*. Absorbent pads 50 may be permanently secured to the shell 20 or may be removable and replaceable for shell 20 re-use. The pad slot 52 may take virtually any shape, but preferably is longitudinally rectangular.

A solvent permeable or perforated backing sheet 60 preferably is bonded to the absorbent pad 50 outward surface and extends laterally beyond pad 50 edges to define a pad mounting periphery 50*a,* and the inward face of the backing sheet 60 at the pad mounting periphery 50*a* preferably is coated with a light backing sheet adhesive 62 to bond to side wall 22 along the periphery of the pad slot 52. See FIG. 17. Peel away cover sheets 70 preferably are secured to the pad 50 inward surface and to the 55 backing sheet 60 with a light cover sheet adhesive 72 to be removable from the absorbent pad 50 when apparatus 10 is to be used. An adhesive-free tab portion 74 of cover sheet 70 preferably is provided for convenient gripping by the user for cover sheet 70 pulling and removal from pad 50.

For the fingernail chamber 30 version of shell 20 having the pad slot 52, the side wall 22 along the fingernail chamber 30 preferably is stylized with a substantially flat bevel or shell ramp portion 82 which angles radially outwardly along the distal direction to a point approaching the middle region of shell side wall 22. In this instance, absorbent pad 50 also is configured to include a corresponding pad ramp portion 84 matching and following the adjacent shell ramp portion 82. See FIGS. 20 and 21. These absorbent pads 50 once again may be permanently secured to the shell 20 or may be removable and replaceable for shell 20 re-use.

For still another embodiment, the enclosure shells are provided at the finger tip portion of a glove. The preferred fingernail polish solvent is acetone or an acetone based solution, for removing either transparent or pigmented polish P. The absorbent pads 50 preferably are formed of foam manufactured by 3M™, and may be closed or open cell foam.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A fingertip enclosure apparatus for fitting over and sealingly enclosing a user finger tip and its fingernail for use with a solvent solution to remove nail polish from the fingernail, the apparatus comprising:

an enclosure shell having a tubular shell side wall with a side wall proximal end and a side wall distal end defining a finger receiving interior space adapted to retain the solvent solution about the finger tip and fingernail, said side wall proximal end including a sealing structure protruding radially inward for making circumferential sealing contact with side surfaces of the finger tip, said side wall distal end being sealingly joined to and closed by a distal end wall, said enclosure shell which includes a bulge protruding radially outward as part of said side wall to define a fingernail chamber in said interior space positionable directly adjacent the fingernail which is adapted to retain additional solvent solution on the fingernail when the finger tip is in said interior space to facilitate removal of the nail polish.

2. The finger tip enclosure apparatus of claim 1, wherein said sealing structure is chosen from the group consisting of a solid rib and a circumferential undulation in said side wall.

3. The finger tip enclosure apparatus of claim 1, wherein said side wall includes at least one internal support rib for strengthening said enclosure shell.

4. The finger tip enclosure apparatus of claim 1, wherein said bulge protrudes distally outward as part of said distal end wall to receive a long user fingernail which extends beyond the finger tip.

5. The finger tip enclosure apparatus of claim 1, wherein said apparatus includes at least one abrasion element which extends into the fingernail chamber closely adjacent the fingernail adapted wherein the user can apply pressure radially inwardly against said side wall to press the abrasion elements into contact with the nail polish softened by the solvent solution and rub the abrasion elements thereagainst to dislodge the nail polish.

6. The finger tip enclosure apparatus of claim 5, wherein the enclosure shell includes an external finger engaging ramp portion to facilitate the user applying pressure radially inwardly against said side wall to press the abrasion elements into contact with the nail polish.

7. A fingertip enclosure apparatus for fitting over and sealingly enclosing a user finger tip and its fingernail, the apparatus comprising:

an enclosure shell having a tubular shell side wall with a side wall proximal end and a side wall distal end, said side wall proximal end including a sealing structure protruding radially inward for making circumferential sealing contact with side surfaces of a human finger, said side wall distal end being sealingly joined to and closed by a distal end wall;

wherein said enclosure shell encloses an interior space and wherein said interior space is at least partly filled with a solution said apparatus additionally comprising a sealing membrane extending across said interior space within said enclosure shell retaining said solvent;

such that when a user fits a finger tip into said proximal end, the finger tip bears against and ruptures said sealing membrane and then enters, said interior space and is immersed in the solution, while side surfaces of the user finger simultaneously make sealing contact with said sealing structure.

8. The finger tip enclosure apparatus of claim 7, wherein the enclosure shell includes a circumferential membrane abutment rib adapted for mounting the sealing membrane, said sealing membrane abutting said membrane abutment rib for strengthened membrane mounting by sealingly bonding said membrane to said membrane abutment rib.

9. The finger tip enclosure apparatus of claim 7, wherein the solution has a gel consistency for resisting accidental spilling and spraying as the finger tip and fingernail are inserted thereinto.

10. A finger tip enclosure apparatus for fitting over and sealingly enclosing a user finger tip and its fingernail, the apparatus comprising:

an enclosure shell having a tubular shell side wall with a side wall proximal end and a side wall distal end, said side wall proximal end including a sealing structure for making circumferential sealing contact with side surfaces of a human finger, said side wall distal end being sealingly joined to and closed by a distal end wall; additionally comprising:

a pad slot in said side wall;

and a solvent absorbing pad secured across and closing said pad slot;

such that a solution deposited onto said absorbent pad is absorbed and transmitted through said absorbent pad and thereby delivered into contact with a user finger within said enclosure shell.

11. The finger tip enclosure apparatus of claim 10, wherein said absorbent pad is impregnated with an abrasive material.

12. The finger tip enclosure apparatus of claims 10, wherein said absorbent pad has pad mounting periphery which protrudes beyond said pad slot and overlaps said side wall, and has pad adhesive on said pad mounting periphery securing said absorbent pad to said side wall as said absorbent pad extends over and closes over said pad slot.

13. The finger tip enclosure apparatus of claim 12, wherein said absorbent pad comprises:

an absorbent pad outward surface and an absorbent pad inward surface;

a solvent permeable backing sheet bonded to said absorbent pad outward surface and extending laterally to define said pad mounting periphery;

and a peel away cover sheet secured to said pad inward surface with a light adhesive to be removable from said absorbent pad when said apparatus is to be used.

14. The finger tip enclosure apparatus of claim 10, Wherein said absorbent pad comprises an abrasive element for dislodging polish from a fingernail within said enclosure shell.

15. The finger tip enclosure apparatus of claim 10, wherein said enclosure shell includes a bulge protruding radially outwardly as part of said side wall having the pad slot therethrough to define a fingernail chamber in said interior space adapted to receive the pad.

16. The finger tip enclosure apparatus of claim 15, wherein said bulge protrudes distally outward as part of said distal end wall to receive a long user fingernail which extends beyond the finger tip.

17. The finger tip enclosure apparatus of claim 10, wherein said pad slot has a rectangular periphery.

* * * * *